US005626094A

United States Patent [19]

Jeffery et al.

[11] Patent Number: 5,626,094

[45] Date of Patent: May 6, 1997

[54] TACTILE LAST-STEP INDICATOR FOR STAIR SAFETY

[76] Inventors: Robert T. Jeffery, 60 Ora Way, #306, San Francisco, Calif. 94131; Brian F. Donnelly, 1118 Salamanca Ct., Davis, Calif. 95616; Robert S. Krolick, 4 Viscaino Way, San Rafael, Calif. 94903

[21] Appl. No.: 398,360

[22] Filed: Mar. 3, 1995

[51] Int. Cl.[6] ..... G08B 6/00; A62B 3/00

[52] U.S. Cl. ..... 116/205; 116/201; 116/DIG. 17

[58] Field of Search ..... 116/205, DIG. 17, 116/201

[56] References Cited

U.S. PATENT DOCUMENTS

| | | | |
|---|---|---|---|
| 259,544 | 6/1882 | Howard | 116/205 |
| 3,408,025 | 10/1968 | Davis | 116/205 |
| 4,080,087 | 3/1978 | Phillips | 404/72 |
| 4,385,586 | 5/1983 | Schriever | 116/205 |
| 4,401,050 | 8/1983 | Britt et al. | 116/205 |
| 4,620,816 | 11/1986 | Kupfer | 434/112 X |
| 4,715,743 | 12/1987 | Schmanski | 404/9 |
| 4,844,000 | 7/1989 | Clement | 116/205 |
| 5,309,863 | 5/1994 | Leeb, Jr. | 116/205 |

FOREIGN PATENT DOCUMENTS

| | | |
|---|---|---|
| 0454318 | 10/1991 | European Pat. Off. . |
| 335365 | 1/1904 | France . |
| 2224154 | 4/1990 | United Kingdom . |
| 9312837 | 7/1993 | WIPO . |

*Primary Examiner*—William A. Cuchlinski, Jr.
*Assistant Examiner*—Willie Morris Worth

[57] ABSTRACT

A device of any material, shape, size, texture, style, color, configuration, and orientation that is affixed, secured, or is an integral part to a staircase handguide, to a handguide support or frame, or to a sidewall. The device provides anyone, ascending or descending the stairs, with a tactile cue that indicates the pedestrian's approach to a final step in a series of steps. A pedestrian senses the tactile indicator to determine when he or she is at the last step so as to change accordingly his or her walking or motion. This safety indicator is intended for the public at large. A pedestrian without sight, with impaired or limited sight, or with compromised sight (due to power outage, light-source outage, smoke-filled stairwell, temporary blindness, etc.) can negotiate stairs with greatly increased safety, speed, and confidence.

17 Claims, 33 Drawing Sheets

TACTILE LAST-STEP INDICATOR FOR STAIR SAFETY

BACKGROUND

1. Field of Invention

This invention relates to safety devices, specifically to such a device that alerts anyone to a safety concern on a staircase.

2. Discussion of Prior Art

Visually-disabled pedestrians can be assisted in their movement by using tactile devices such as mobility guides, barrier alerts, and direction finders for evacuation and exiting. These handfelt or foot-felt devices provide needed directional information. Many of these devices are limited in use because they are designed for only emergency exiting in hallways and on airplanes. The rest are aimed at controlling the walking patterns of the visually-handicapped. All of these devices serve as "direction-finders" on planar walking surfaces. They are not functional with staircases, provide no staircase safety warning, and do not protect staircase-users from falls and injuries near a last step.

In the U.S., and in many foreign countries, handguides are universally provided adjacent all staircases. Anyone in need of handguides uses them.

As staircase pedestrians reach the end of the stairs, they prepare to step from the obliquely pitched staircase onto the level, horizontal surface of the floor or landing. A problem arises when pedestrians are unable to see or to see clearly the last step, where the stairs terminate.

With impaired or restricted visibility, all pedestrians are in a dangerous situation when reaching the end of a staircase. They can believe, mistakenly, more steps to be ahead when actually no more exist. Alternatively, they can perceive, incorrectly, no more steps to be remaining when in fact one or more steps lie ahead. With the wrong impression, they can easily fall and injure themselves and, in the process, cause others around them to fall.

Guiding structures, railings, and handguides are of limited benefit in identifying a last step due to their confusing diversity of shapes, sizes, and mounting designs. A handguide on one staircase can be vastly different from that of another. No standardization for handguides exists. Typically, handguides terminate far beyond the last step. Consequently, the user of a staircase does not know where the staircase will end if lighting conditions are dark or the user is visually impaired. Moreover, specific handguide length, relative to a last step, varies considerably. Even handguide "bends", when present, are located in a perplexing variety of distances relative to the last step. There is no recognizable uniformity concerning bend positioning. For that reason, bends cannot serve as useful or reliable tactile alerts either. They provide a puzzling frame of reference at the ends of staircases.

For the average staircase pedestrian traversing a well-lit staircase, exiting the staircase usually poses no problem. He or she merely views the last step and safely moves onto the level landing or onto the floor level. While the handguide serves to help keep one's balance, the user's clear vision serves to inform that the last step is forthcoming. However, when staircase pedestrians are unable to see or to see clearly the steps they are using, they have lost the ability to exit safely. While handguides assist with balance, they do not provide a reliable, recognizable message in advance as to when the steps on a given staircase are about to terminate.

Statistics indicate that 70% of the one million annual stair-related injuries in the U.S. occur at the top or bottom last three steps. It is here where users require additional safety information, especially under certain circumstances in which users are, for example: blind, visually impaired, elderly, bifocal users, people who suffer from decreased visual acuity or depth perception, or anyone experiencing temporary visual impairment due to the influence of drugs or due to darkness caused by events such as an electrical power outage, a light-source outage, or obscuring smoke from a building fire.

While existing tactile devices serve as adequate direction finders, none has solved the foregoing serious and more common problem associated with the last step on a staircase.

For instance, Howard, in U.S. Pat. No. 259,544, Jun. 13, 1882, shows a direction finder that comprises a long series of indicators on hallway railings to indicate fire exit locations. This device does not address safety for an individual who might inadvertently miscue with a last step on a staircase.

Davis, in U.S. Pat. No. 3,408,025, Oct. 29, 1968, is likewise preoccupied with directional exiting and evacuation, specifically for aircraft passengers. He does not solve the last-step problem.

Schriever, in U.S. Pat. No. 4,385,586, May 31, 1983, makes only an incremental improvement on Howard's and Davis's devices. He shows tactile indicators, liberally mounted on hallway walls, to provide, in addition to recommended escape direction, the relative number of doorways to the exit door. He gives great importance to the function of "distance" with regard to an exit door.

A tactile direction-indicator has been developed for the fire fighting industry. Clement, in U.S. Pat. No. 4,844,000, Jul. 4, 1989, describes a direction-indicating clamp for attachment to fire fighting hose lines. Secured at prescribed distances along a fire hose, indicator clamps point in the direction of the building exit. Again, this is simply an emergency-directional device for evacuation purposes. Moreover, this device permits attachment to and usage in conjunction with fire-fighting apparatus only. Similar to Howard's, Davis's, and Schriever's devices, Clement's device is only an evacuation exit-finder and a direction-indicating device. It does not relate to staircases, nor does it solve the last-step problem.

There have also been tactile devices for walkways which serve only the blind or visually impaired. For instance, Phillips, in U.S. Pat. No. 4,080,087, Mar. 21, 1978, devised humped floor-plates that are affixed to pedestrian paths. When many are joined together, they serve as a continuous, rail-less walkway—a type of mobility guide. Instead of using canes, sticks, or seeing-eye dogs, visually handicapped persons "feel" the special surface with their feet in order to walk safely along a predesignated trail. Because it is a predetermined guideway, it is another type of directional device. It does not solve the staircase problem.

Schmanski, in U.S. Pat. No. 4,715,743, Dec. 29, 1987, devised a slightly different version of a mobility guide for use only by the visually handicapped. It provides the blind with floor tiles which serve as barrier alerts to possible hazards, such as street curbs, or to provide direction for travel. The main difference between Schmanski's and Phillips' devices is the arrangement and composition of surface bumps on the floor tiles. In both cases, however, these designs have major limitations. They are for exclusive use by the visually handicapped who, unlike the general public, are predisposed to foot and cane sensing of barrier-alert-type walkway indicators. Additionally, these last two products are intended to be walking tiles for level sidewalk or pathway applications, not staircase applications.

All of the foregoing prior-art devices fail to address a major problem encountered by pedestrians on stairways. Whenever pedestrians are ascending or descending stairs, whether they are totally/partially blind, visually impaired, or visually compromised, all are at risk of falling near the last step. Evacuation-exit direction-finders do not address this problem of last-step stair safety at all. Neither do the guideway or barrier-guide floor files for the handicapped.

OBJECTS AND ADVANTAGES

It is accordingly an object of the present invention to provide pedestrians with a means, alternative to visual, for accurately identifying the last step in a series of steps on a staircase.

Several additional objects and advantages are:

(a) to provide pedestrians with increased safety on stairways, as opposed to safety in hallways or in aircraft walkways;

(b) to provide a tactile means for detecting the end of a stairway, as opposed to a tactile means for finding an exit direction or for ascertaining the relative distance to an exit;

(c) to provide a specific reference point and a point-of-warning for staircase pedestrians, as opposed to a designation of an entire pathway;

(d) to provide a tactile warning that primarily uses detection by one's hand, instead of detection by one's foot;

(e) to provide increased safety under many circumstances, not just during a fire.

Further objects and advantages are to provide an indicator which helps prevent unnecessary falls, injuries, accidents, and associated pain and suffering, which helps reduce worker's compensation, insurance, and medical expense while minimizing lost worker productivity, which is small in size yet distinctive and easy to feel, which takes up very little space and blends in with any architectural styling, which attaches onto curved as well as flat surfaces, which can come in a high-contrast color-configuration to offer high visibility for increased public awareness, which incorporates a user-friendly peel-and-stick adhesive backing to facilitate retrofit attachment onto a wide variety of surface materials, and which uses a "no-talent-required" template to make indicators easy to install for quick, accurate, professional-looking results.

Still further objects and advantages of our last-step indicator will become apparent from a consideration of the drawings and ensuing description.

DESCRIPTION OF DRAWINGS

FIGS. 2 through 7 are exploded views of the last-step indicator.

FIG. 2 is an oblique view of the last-step indicator showing three parallel elements.

FIG. 3 is a detail, sectional view taken in the direction indicated by section line 3—3 in FIG. 2.

FIG. 4 is a plan view of the last-step indicator.

FIG. 5 is plan view of a variation of the last-step indicator.

FIG. 18A is a detail, sectional view taken in the direction indicated by section line in FIG. 17.

FIG. 18B illustrates removal of a release sheet that protects the underside of the template and its elements.

FIG. 18C shows the template and elements being positioned over a mount surface.

FIG. 18D shows the template contacting the mount surface with elements still suspended.

FIG. 18E shows the effects of downward pressure on the template's dome points and the resulting contact of the elements against the mount surface.

FIG. 18F shows the template and elements after downward pressure has been relieved.

FIG. 18G shows the template in the process of being peeled away from adhesive-secured elements.

FIG. 18H shows the elements properly mounted in correct orientation and spacing.

FIGS. 19A through 28B illustrate examples of handguide indicators and of an installation device that serve as alternatives to the foregoing preferred embodiment.

FIGS. 19A through 19C show, in plan view on a small segment of handguide, alternative examples of elongated indicator elements with regard to element orientation, to element size, and to the number of elements.

FIG. 19A shows two identical elements whose end points are aligned in a direction that is perpendicular to the direction of the handguide.

FIG. 19B shows three identical elements whose end points are aligned in a direction that is diagonal to the direction of the handguide.

FIG. 19C shows four elements of varying length.

FIG. 20A is a plan view of a dome-shaped, screw-type dement.

FIG. 20B is a side view of a dome-shaped, screw-type element.

FIG. 21A illustrates a push-rivet dement, positioned over a predrilled opening, with angled fins fully extended.

FIG. 21B illustrates a push-rivet dement, inserted into the predrilled opening, with upper angled fins compressed against the opening sidewall and with lower angled fins fully extended below the opening.

FIG. 22A is an oblique view of a push-style insert.

FIG. 22B is a side view of the push-style insert.

FIG. 22C is a sectional, side view of a dome-shaped, snap-in element, a sectional, side view of a mating push-insert taken in the direction indicated by section line 22C"—22C" in FIG. 22A, and a sectional, side view of a predrilled opening in a handguide.

FIG. 22D shows, in a sectional, side view, all three components of FIG. 22C as positioned when installation is properly complete.

FIG. 23A shows the expansion element in side view as positioned over a predrilled opening shown in sectional, side view.

FIG. 23B shows the expansion element positioned in the predrilled opening.

FIG. 23C shows the expansion element after application of upward force to a pull-stem, expanding the bottom part of the rivet stem against the edge of the opening.

FIG. 23D shows the expansion element after the pull-stem is clipped off flush to the surface of the dome-shaped element.

FIG. 24A is a side view of a drill-guide template.

FIG. 24B is a plan view of a drill-guide template.

FIG. 24C is a sectional, side view of a drill-guide template taken in the direction indicated by section line 24C—24C in FIG. 22B.

FIG. 24D is a side view of the drill-guide template positioned onto a pipe-style handguide.

FIG. 24E is a side view of a drill-guide template after a drill bit has penetrated the handguide, which is shown in sectional, side view.

FIG. 25A is an enlarged plan view of a membrane-integrated indicator.

FIG. 25B is a detailed sectional view of a membrane-integrated indicator taken in the direction indicated by section line 25B—25B in FIG. 25A.

FIG. 25C illustrates a membrane-integrated indicator when applied to a segment of handguide.

FIG. 26A shows three elements aligned in a direction that is perpendicular to the direction of the handguide.

FIG. 26B shows four elements aligned in a direction parallel to the direction of the handguide.

FIG. 26C shows four elements aligned in a direction diagonal to the direction of the handguide.

FIG. 27A' is a side view of a wedge-shaped indicator and timing block.

FIG. 27A" is an oblique view of a wedge-shaped indicator and timing block.

FIG. 27A"' is a frontal view of a wedge-shaped indicator and timing block.

FIGS. 28A and 28B show an alterative style of last-step indicator that uses an audio signal to indicate an upcoming last step.

FIG. 28A is a simplified schematic of an electronic-style last-step indicator that produces an audio signal.

FIG. 28B shows an example of placement of an electronic last-step indicator on a staircase.

REFERENCE NUMERALS IN DRAWINGS

Figure 1:
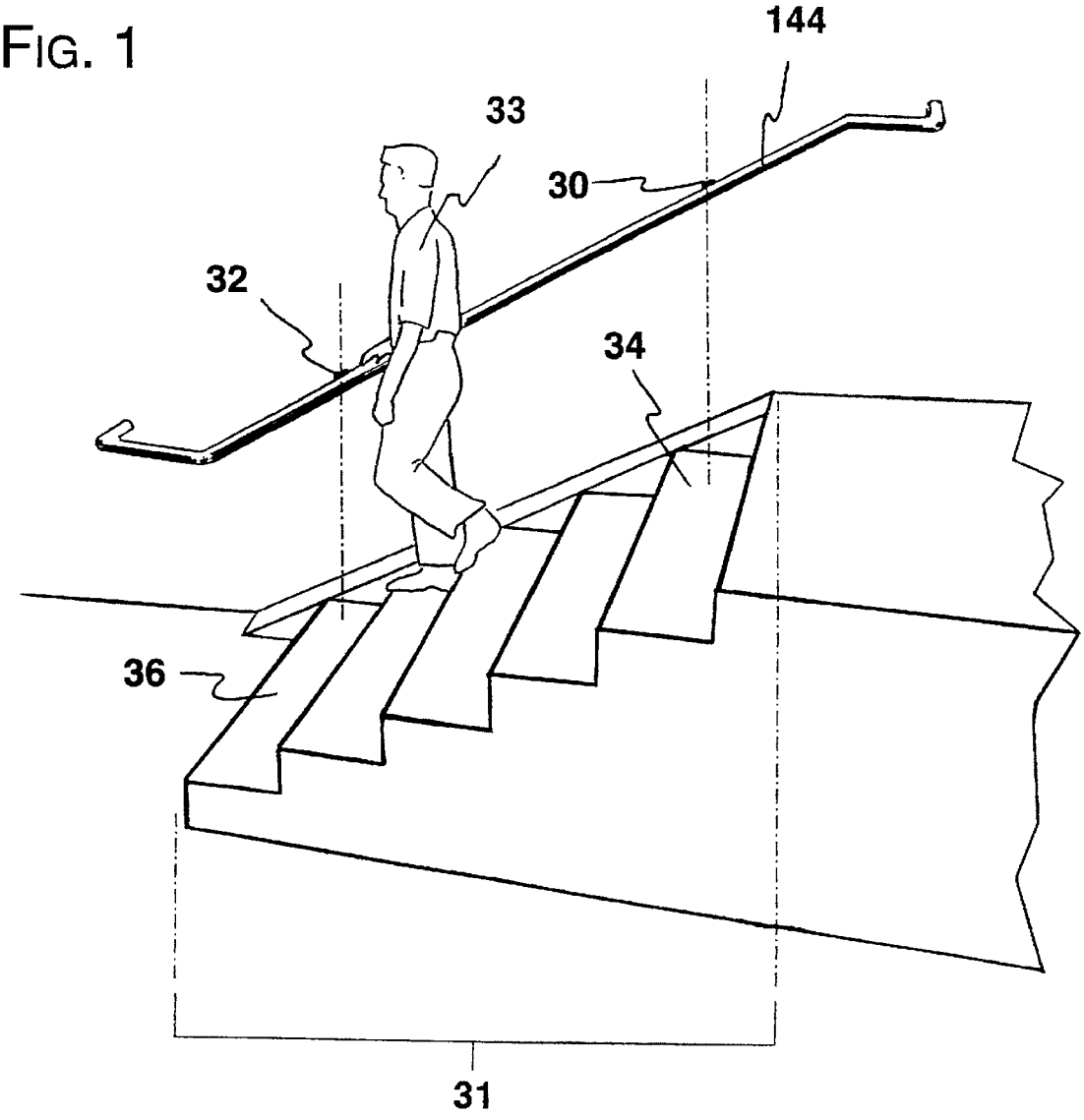
FIG. 1 is an oblique, side view illustrating a last-step indicator, in accordance with our invention, installed at both top and bottom ends of a staircase.

| | | | |
|---|---|---|---|
| 22c' | top part | 48 | central radius point |
| 22c" | middle part | 50 | right radius point |
| 22c"' | bottom part | 52 | same radius |
| 30 | top-staircase indicator | 54 | left element's surface |
| 31 | staircase | 56 | central element's surface |

-continued

| | | | |
|---|---|---|---|
| 32 | bottom-staircase indicator | 58 | right element's surface |
| 33 | staircase pedestrian | 60 | left element diameter |
| 34 | next-to-top step | 62 | central element diameter |
| 36 | next-to-bottom step | 64 | right element diameter |
| 38 | left element | 66 | left space |
| 40 | center element | 68 | right space |
| 42 | right element | 70 | total cross-sectional width |
| 44 | flat surface | 72 | element length |
| 46 | left radius point | 74 | left axis |
| 76 | central axis | 130 | hand position |
| 78 | right axis | 132 | handguide bend |
| 80 | left-most element | 133 | pedestrian hand |
| 82 | right-most element | 134 | high point |
| 84 | top-central element | 136 | low point |
| 86 | bottom-central element | 138 | uniform handguide surface |
| 92 | tip-to-tip spacing | 140 | dimension |
| 94 | left and right-most element length | 142 | location |
| 96 | top-central element length | 144 | pipe-style handguide |
| 98 | bottom-central element length | 146 | convex-mount-surface profile |
| 100 | four-element configuration-length | 148 | flat-mount-surface profile |
| 102 | smooth exterior surface | 150 | concave-mount-surface profile |
| 104 | composite material | 152 | upper floor level |
| 106 | flat base | 154 | lower floor level |
| 108 | adhesive | 156 | midway landing |
| 110 | adhesive mount surface | 158 | upper staircase 3-element indicator |
| 112 | release sheet | 160 | lower staircase 3-element indicator |
| 113 | rounded end | 162 | upper staircase 4-element indicator |
| 114 | textured exterior surface | 164 | lower staircase 4-element indicator |
| 116 | bump | 166 | flexible flat surface |
| 118 | ridge | 168A | blister (lower or right most) |
| 120 | top last-step | 168B | blister (mid) |
| 122 | top-staircase horizontal-space | 168C | blister (upper or left most) |
| 124 | bottom last-step | 170 | line reference marking |
| 126 | bottom-staircase horizontal-space | 172 | triangle reference marking |
| 128 | relative foot position | 174 | numeric reference marking |
| 176 | underneath surface | 230 | dome shaped, snap-in element |
| 178 | retaining edge | 234 | single opening |
| 180 | template | 236 | handguide surface |
| 182 | blister recess | 238 | ring-ridge |
| 186 | mount surface | 239 | dome shaped, expansion element |
| 188 | left dome point | 240 | central pull-stem |
| 190 | central dome point | 242 | expanded rivet stem |
| 192 | right dome point | 246 | dome surface |
| 194 | single length | 248 | flexible drill-bit template |
| 196 | longer length | 250 | left drill-bit guide |
| 198 | half-sphere, dome | 252 | central drill-bit guide |
| 200 | hexagonal recess | 254 | right drill-bit guide |
| 202 | screw | 256 | drill-bit guide shaft |
| 204 | dome-shaped push-rivet | 258 | drill-bit |
| 206 | predrilled opening | 260 | designated hole |
| 208 | thin-walled handguide | 262 | solid, flexible, flat membrane |
| 210 | upper angled-fin | 264 | integrated dome |
| 212 | rivet stem | 266 | contact-adhesive layer |
| 214 | wall surface | 268 | protective peel-off liner |
| 216 | lower angled-fin | 270 | linear alignment |
| 218 | handguide opening-edge | 272 | block-mount surface |
| 220 | element-insert fin | 274 | leading surface |
| 222 | central post | 276 | tactile edge |
| 224 | flange | 278 | stationary handguide frame |
| 226 | snap-rivet hole | 280 | moving handguide |
| 228 | ring-shaped recess | 282 | pedestrian step |
| 284 | primary-encounter-block | 298 | "interval for stepping" |
| 286 | first cadence-block | 300 | audio-style last-step indicator |
| 288 | second cadence-block | 302 | external pressure switch |
| 290 | escalator step | 304 | power source (PS) |
| 292 | termination point | 306 | signal generator/processor (CPU) |
| 294 | "interval number one" | 308 | speaker(S) |
| 296 | "interval number two" | | |

SUMMARY

The last-step indicator of the present invention is a device that provides a pedestrian with a non-visual indication of the end of a staircase. It consists of a tactile or haptic element that is mounted in line with the next-to-last step of a staircase in a position where it can be manually detected and recognized when encountered by the stair user at the end of the staircase.

DESCRIPTION OF INDICATOR AS A PROTRUSION

FIG. 1

Top and bottom last-step indicators 30 and 32, in accordance with the invention, typically are placed on a banister or handguide 144 of a staircase 31 as illustrated by the oblique view in FIG. 1. Top-staircase indicator 30 is at the upper end of handguide 144, directly over next-to-top step 34, and bottom indicator 32 is at the lower end of handguide 144, directly over next-to-bottom step 36. Indicators 30 and 32 are nubbins or protuberances which are fastened to handguide 144 and which project up about 3.2 mm or 0.13 inch therefrom so as to be easily recognized when felt by the hand of a staircase pedestrian 33, as explained more fully below.

OPERATION OF INDICATOR AS A PROTRUSION

As shown in FIG. 1, pedestrian 33 walking down staircase 31 slides one hand along handguide 144 while walking down the staircase. Nearing the end of the staircase, he or she encounters, touches, senses, and recognizes indicator 32. At that point, the stair user will know, from instruction or previous encounters with indicator 32, that there is one final step remaining in the staircase. Now cognizant that the staircase is about to terminate, the pedestrian is able to confidently proceed one final step from the next-to-bottom step onto the level floor or landing, safely changing his or her waking pattern.

The operation of the indicator takes advantage of a physical property shared by nearly all handguides. Most handguides provide a continuous, smooth surface, such as varnished wood or polished stainless steel. At the very least, they provide a continuous, consistent texture, such as concrete. As a result, any uniform handguide surface can be given a specific point of reference with the simple addition of a protuberance. Therefore, a tactile deviation that protrudes sufficiently beyond the surface of the handguide can be encountered, manually sensed, and immediately recognized for its prominence.

As a pedestrian slides one hand along the uniformly smooth handguide surface, he or she quickly develops a familiarity with that specific surface. Indicators 30 and 32 in FIG. 1 provide a valuable and necessary safety cue. Associating both indicator 32 and step 36 with a final step, the pedestrian is therefore apprised, at the location of detection, to expect one more step in the series of steps on this staircase. Thus, even though it may not be visually apparent, a last-step is safely encountered. Manually detected indicators offer ample pedestrian notice that the end of the stairs is only one last step away.

DESCRIPTION

Figure 2:
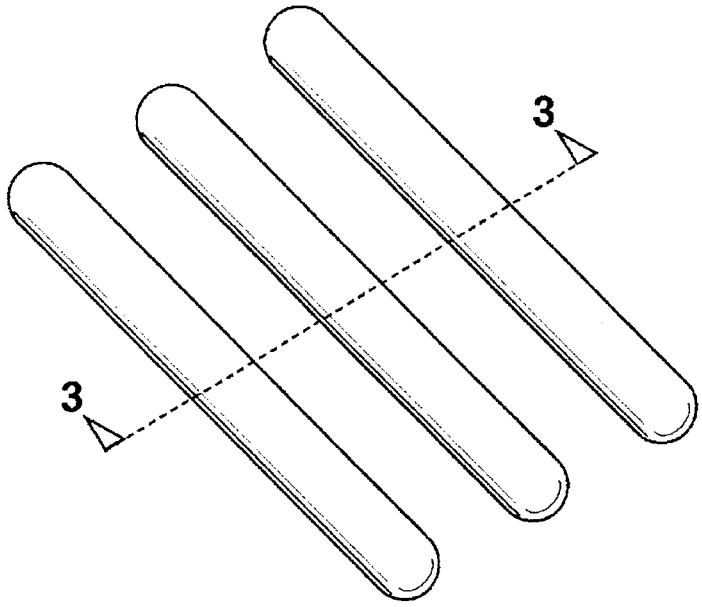
Figure 3:
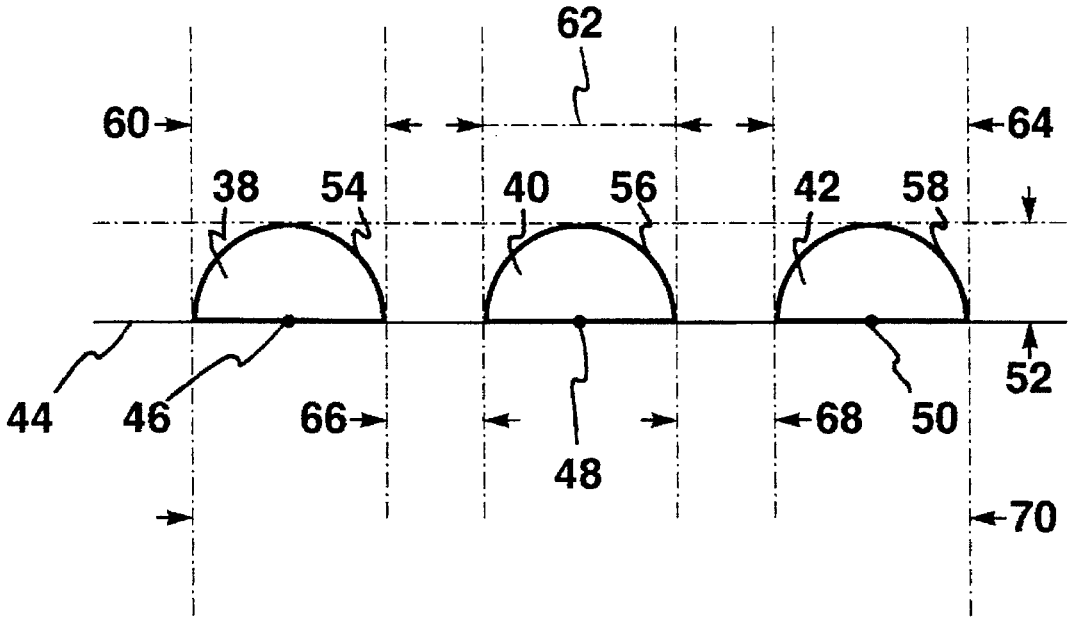
Figure 4:
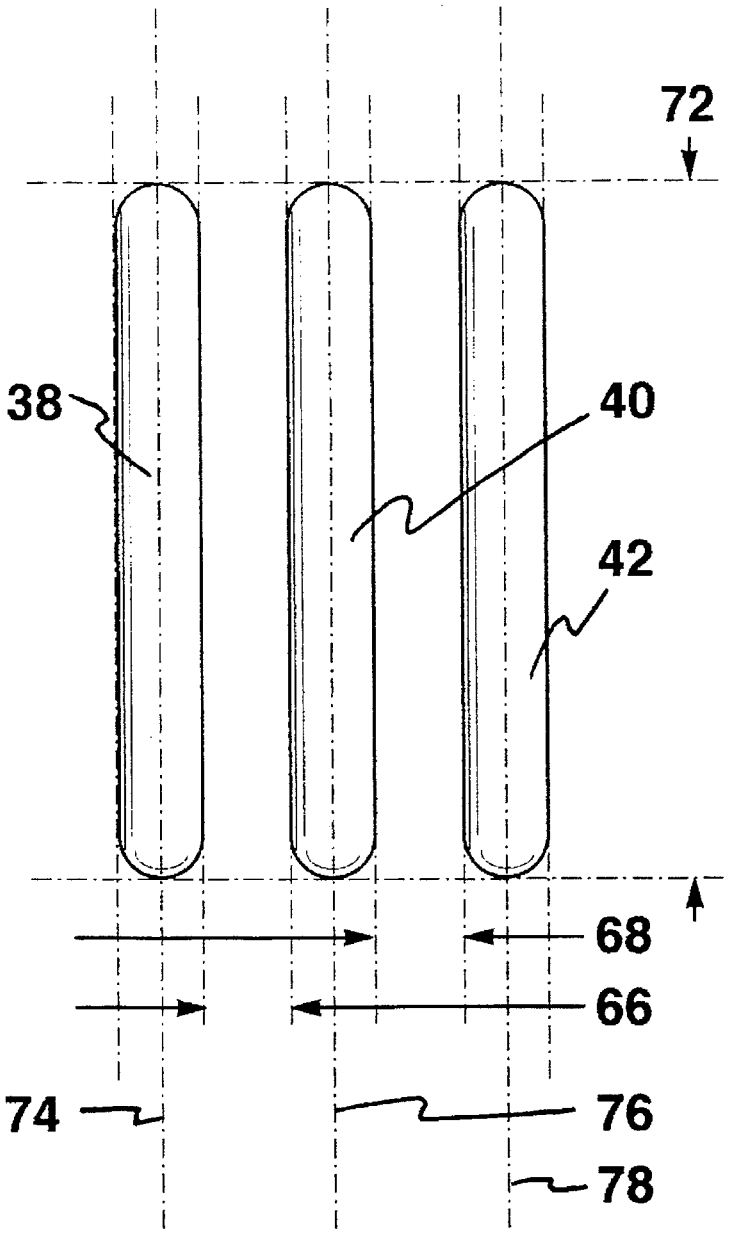

Easy Recognition of Three-Element Indicator
FIGS. 2, 3, and 4

Preferably, indicators 30 and 32, as shown in FIG. 1, are each a tactile device which comprises an array of elongated elements. Each is shown in exploded oblique detail in FIG. 2 as three elements. Each element has a long, thin shape. The shape is obtained by longitudinally slicing a cylinder in half and rounding the end-points. The flat undersurface, unseen from this perspective, is mounted on a handguide. In this arrangement, the elements are side-by-side and parallel to each other. They are spaced equally and are of equal length. A mid-element cross-section taken at line 3—3 is detailed in FIG. 3.

Each element in FIG. 3, which shows an exploded cross-sectional detail, is a half-circle-profile. Left, central, and right elements 38, 40, and 42 are mounted on a flat surface 44, which is the upper surface of handguide 144 in FIG. 1. Each element has an axis that is represented in this sectional view as left, central, and right radius points 46, 48, and 50. Each element has the same radius 52. Such radius is measured from a radius point to the curved, exterior surface of the element. The distance between point 46 of left element 38 to a left element's surface 54 is typically 3.2 mm or 0.13 inch. Similarly, the distance between radius points 48 and 50 of respective central and right elements 40 and 42 to respective surfaces 56 and 58 is the same, 3.2 mm or 0.13 inch. Thus, the typical diameter 60, 62, and 64 of each element is 6.4 mm or 0.25 inch. Adjacent elements are separated by a left and right space 66 and 68 which is typically 3.2 mm or 0.13 inch each. A total cross-sectional width 70 of all three elements 38, 40, and 42, including space 66 and 68, is typically 25.6 mm or 1.00 inch.

The elements of FIG. 2 are shown in exploded, plan view in FIG. 4. A length 72 of each of the elements 38, 40, and 42 is typically 35.0 mm or 1.38 inches. Each element is centered over parallel and equally-spaced axes. Left element 38 is centered over a left axis 74; central element 40 is centered over a central axis 76; and right element 42 is centered over a right axis 78. Space 66 is equal to space 68.

OPERATION

Easy Recognition of Three-Element Indicator

The use of spaced, multiple elements along three axes, as seen in FIGS. 2, 3, and 4, provides differentiation. It offers the pedestrian an unusual feel that is quickly identifiable from any unrelated prominent tactile feature that might be encountered on a handguide. For instance, if the elements were to be aligned abutting one another in a packed, close-together fashion, they might resemble a single raised edge and be mistaken for something else. E.g., one might think they were an improperly disposed wad of flattened, used chewing gum. Alternatively, if only one axis or element were to be used, the element might be too narrow to be easily detected. Moreover, a wide version of a single element might resemble the wad of gum and not be easily distinguished. The uniqueness of the design insures against mistaken identification. There is little chance for a foreign tactile protuberance to be confused with the last-step indicator.

DESCRIPTION

Figure 6A:
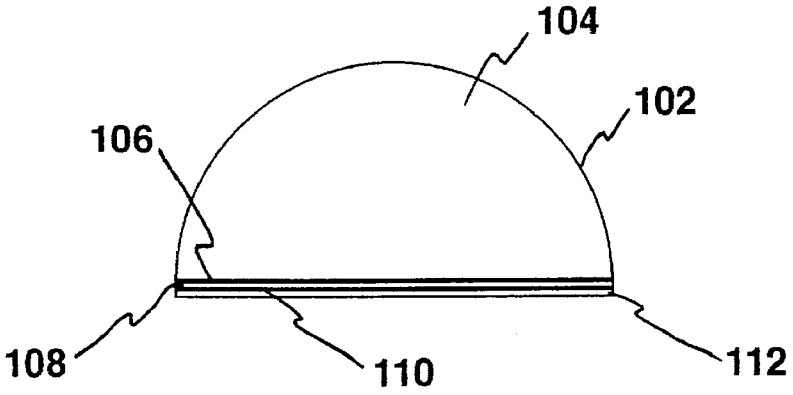
FIG. 6A is an enlarged, sectional view showing greater detail of one element from FIG. 3 and exhibiting a smooth exterior surface.
Figure 6B:
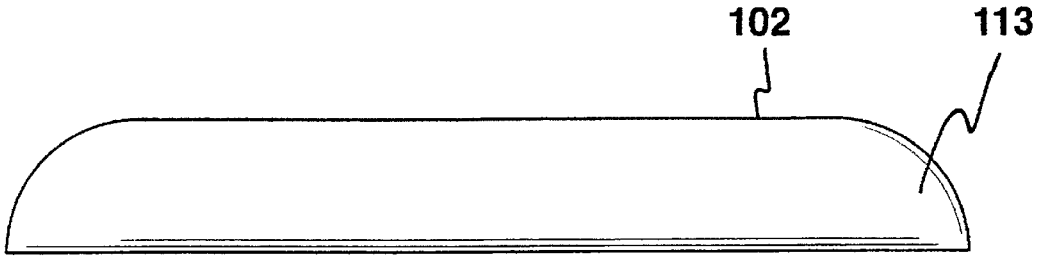
FIG. 6B is a side view of the element in FIG. 6A.

Physical Features
FIGS. 6A and 6B

Greater detail of any one element of FIG. 3 is shown by the enlarged, sectional view in FIG. 6A. This element typically has a smooth exterior surface 102. The element's composite material 104 is typically opaque black or bright yellow and consists of any of a variety of materials, preferably plastic but may also be wood or metal or a composite material. A flat base 106 of the element is coated with an adhesive 108. The side of the adhesive which is not adjacent to base 106 is called an adhesive-mount surface 110. Surface 110 has a temporary protective covering or release sheet 112. A full side view of the element in FIG. 6A, illustrating, again, smooth exterior surface 102, is shown in FIG. 6B. Exposed, sharp exterior edges are eliminated by way of rounding, sloping, and/or providing a radial surface to the ends of the element as evidenced by a rounded end 113.

OPERATION

Physical Features

Elements, as seen in FIGS. 6A and 6B, have a smooth exterior surface 102 and rounded ends 113 to minimize snagging of skin as well as clothing and articles that might inadvertently brush against them. Flat base 106 is coated with contact adhesive 108 that is protected with release sheet 112. After the release sheet is removed just before installation to expose the adhesive, the element is pressed into position. The release sheet may directly contact adhesive mount surface 110 as shown or it may cover but not directly contact surface 110 if it is held slightly apart by a frame, such as by a mounting template.

In order to increase safety awareness and to draw public attention to indicator installations, the elements can be in high-contrast colors, such as with bright yellow alternating with black. Additionally, this visual enhancement can help to supplement tactile recognition and detection when needed by staircase users who are partially sighted or capable of some sight.

DESCRIPTION

Additional Safety Message Provided by Four-Element Indicator

FIG. 5

Figure 5:
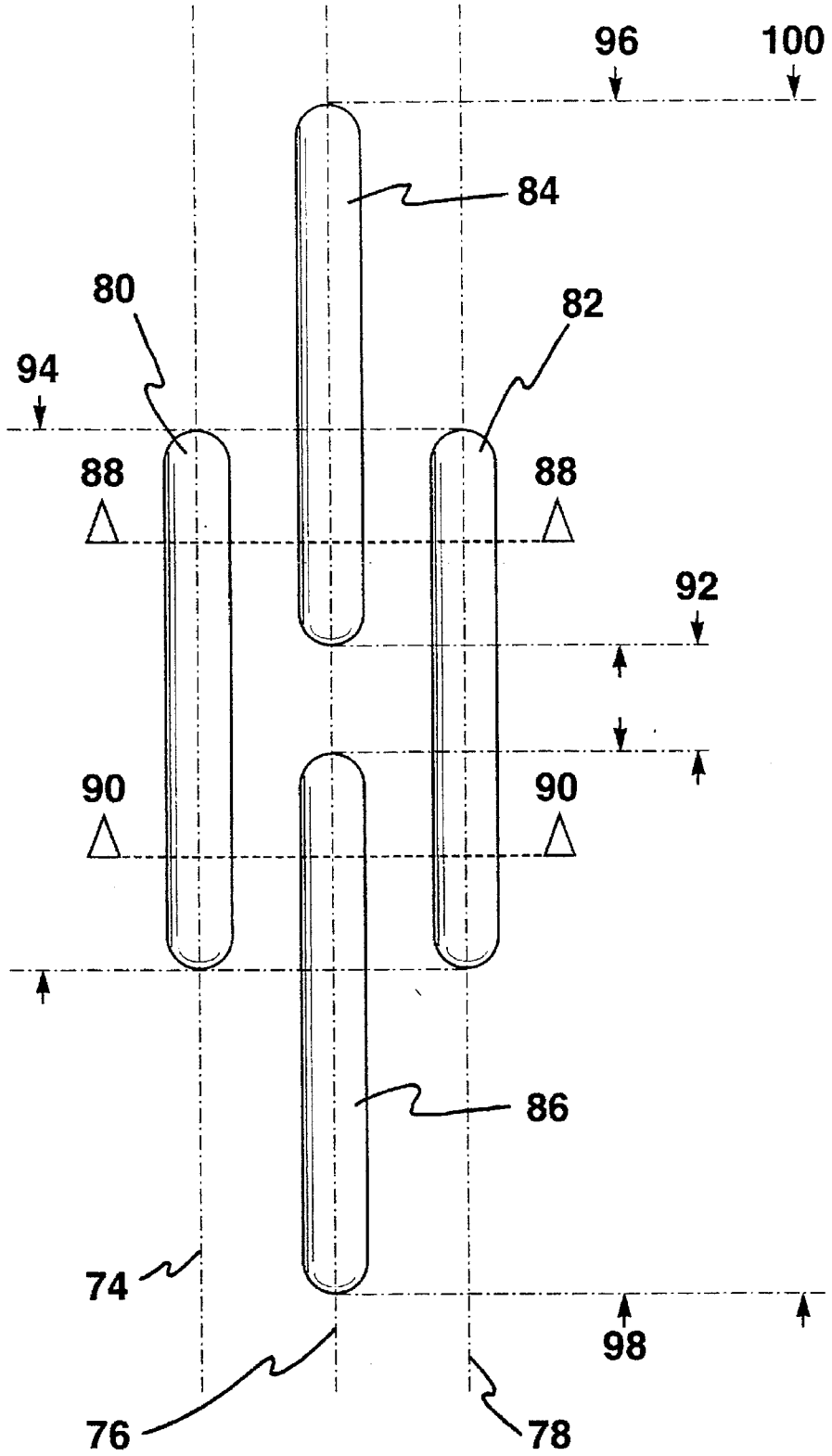

A variation of the last-step indicator comprises an indicator having four elements 80, 82, 84, and 86 is seen in the exploded plan view of FIG. 5. Axes 74, 76, and 78 and their configuration in FIG. 5 are identical to those in FIG. 4. However, in contrast to the single central element in FIG. 4, there are two central elements in FIG. 5, a top-central element 84 and a bottom-central element 86. An upper cross-section taken at 88—88 and a lower cross-section taken at 90—90 in FIG. 5 have the identical sectional profile shown by FIG. 3. A tip-to-tip spacing 92 separating the adjacent ends of elements 84 and 86 is typically 7.9 mm or 0.31 inch. Length 94 of left-most element 80 and right-most element 82 is typically 34.9 mm or 1.37 inches each. Length 96 of element 84 and length 98 of element 86 are are also typically 34.9 mm or 1.37 inches each. Total four-element configuration-length 100 is typically 77.7 mm or 3.05 inches. All axes and elements are parallel.

OPERATION

Additional Safety Message Provided by Four-Element Indicator

The four-element indicator in FIG. 5 is useful in two ways. First, it serves the purpose of indicating an upcoming last step. Secondly, it is recognized as a value-added indicator, offering additional information. Specifically, it is associated with the proximity of another staircase nearby to the one that is currently being exited. Its positioning signifies that another set of stairs, such as by a landing, is about to be encountered. Detection of the four element indicator warns the stair user of the potential danger. He or she is made cognizant that another staircase is close-by and, therefore, poses a stair-entry hazard. The recognizable pattern of the four-element indicator serves to express the additional warning.

DESCRIPTION

Optional Features of the Element

Figure 7A:
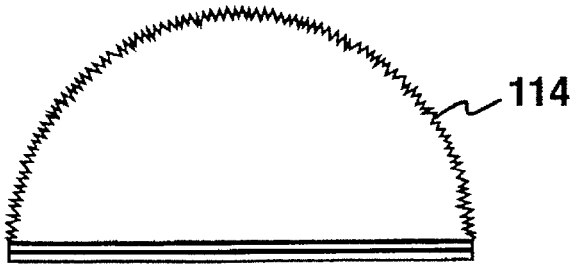
FIG. 7A is an enlarged, sectional view of one element from FIG. 3 showing a textured exterior surface.
Figure 7B:
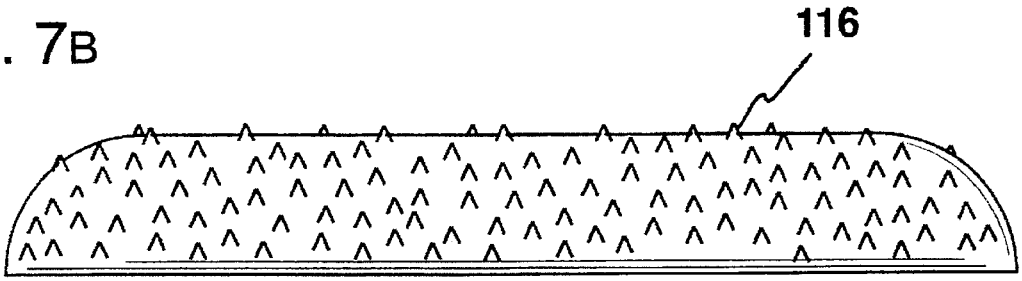
FIG. 7B is an enlarged, side view of one element from FIG. 3 showing an exterior surface of bumps.
Figure 7C:
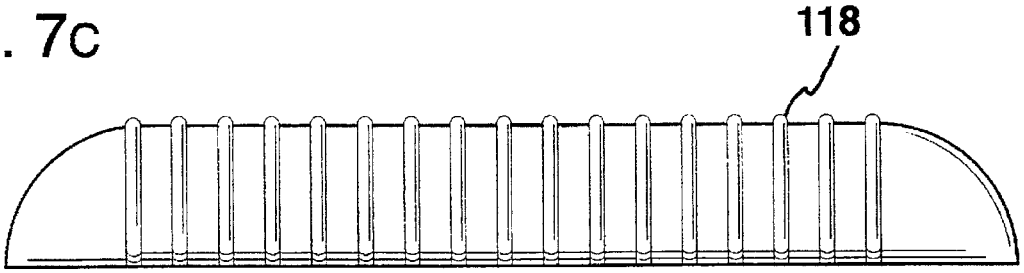
FIG. 7C is an enlarged, side view of one element from FIG. 3 showing an exterior surface of ridges.

FIGS. 7A, 7B, and 7C

Any one of the three elements from FIG. 3 is shown in an enlarged, sectional view in FIG. 7A. Unlike the element with smooth surface 102 in FIGS. 6A and 6B, this element has a textured exterior surface 114. The element in FIG. 7A has the same adhesive configuration and composite material options as the one illustrated and described in FIG. 6A.

Examples of the element in FIG. 7A are shown in full side view in FIGS. 7B and 7C. From this orientation, these elements display examples of textured surfaces. The texture can include small nubbins, pimples, or bumps, such as a bump 116, or a series of small surface ridges, such as a ridge 118, that are essentially perpendicular to the element's length dimension.

OPERATION

Optional Features of the Element

If more hand sensitivity to the element is required, the element's surface can have more texture, as seen in FIGS. 7A, 7B, and 7C. Texture includes, but is not limited to, bumps 116 and ridges 118. Elements, as shown in FIGS. 6A and 7A with adhesive 108, flat base 106, and release sheet 112, are designed for retrofit installation on existing handguides. Indicators, however, can be manufactured and integrated into new handguides. In such cases, welds can be used in place of adhesive, or elements can be carved or molded into the handguide material, or elements can be anchored in any way into or onto the handguide.

Other features, in addition to prominent surface texture, can enhance recognition. Such features can increase detection by staircase users who are partially sighted or capable of some sight. For instance, element color and light can be luminous, fluorescent, iridescent, reflective, holographic, prismatic, or self-lit (such as with a light-emitting diode, light filament, electron-stimulated gas or plasma, or any other light or color producing mechanism).

DESCRIPTION

Indicator Positioning on Handguides

FIG. 8

Figure 8:
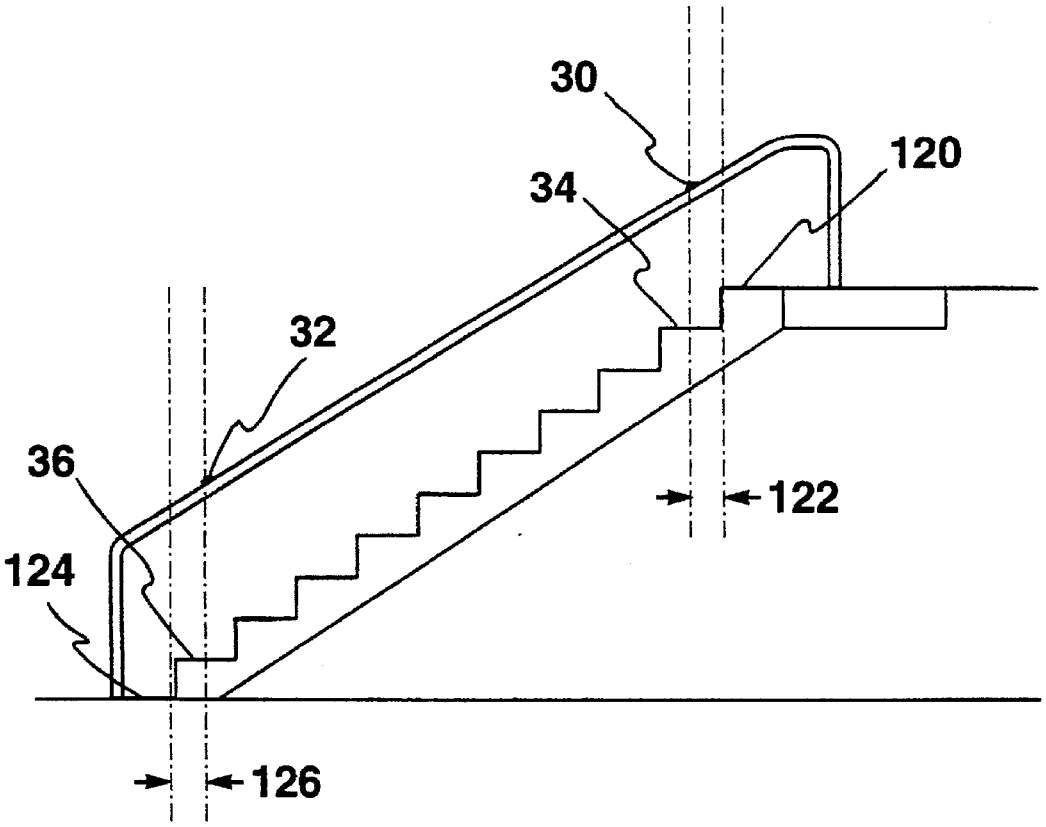
FIG. 8 is a side view of two last-step indicators on a staircase handguide showing relative distance between an indicator and a last step.

Installed indicators 30 and 32 on a staircase handguide are shown in a side view in FIG. 8. Indicator 30 is typically installed on the handguide at a location directly above next-to-top step 34. Indicator 30 and a top last-step 120 are separated by a (top staircase) horizontal-space 122. Indicator 32 is typically installed on the handguide at a location directly above next-to-bottom step 36. Indicator 32 and a bottom last-step 124 are separated by a (bottom staircase) horizontal-space 126.

OPERATION

Indicator Positioning on Handguides

Because stair users can fall at either top or bottom ends of a staircase, indicators are placed at both ends as seen in FIG. 8. In order to provide meaningful tactile warnings, indicators 30 and 32 are located a certain distance or horizontal-space 122 and 126 that precedes final pedestrian steps 120 and 124 respectively. Typically, the indicators are located directly over next-to-top step 34 and next-to-bottom step 36 in order to provide traversing stair users with sufficient notice.

DESCRIPTION

Pedestrian Encounter and Tactile Discernment of Indicator

Figure 9:
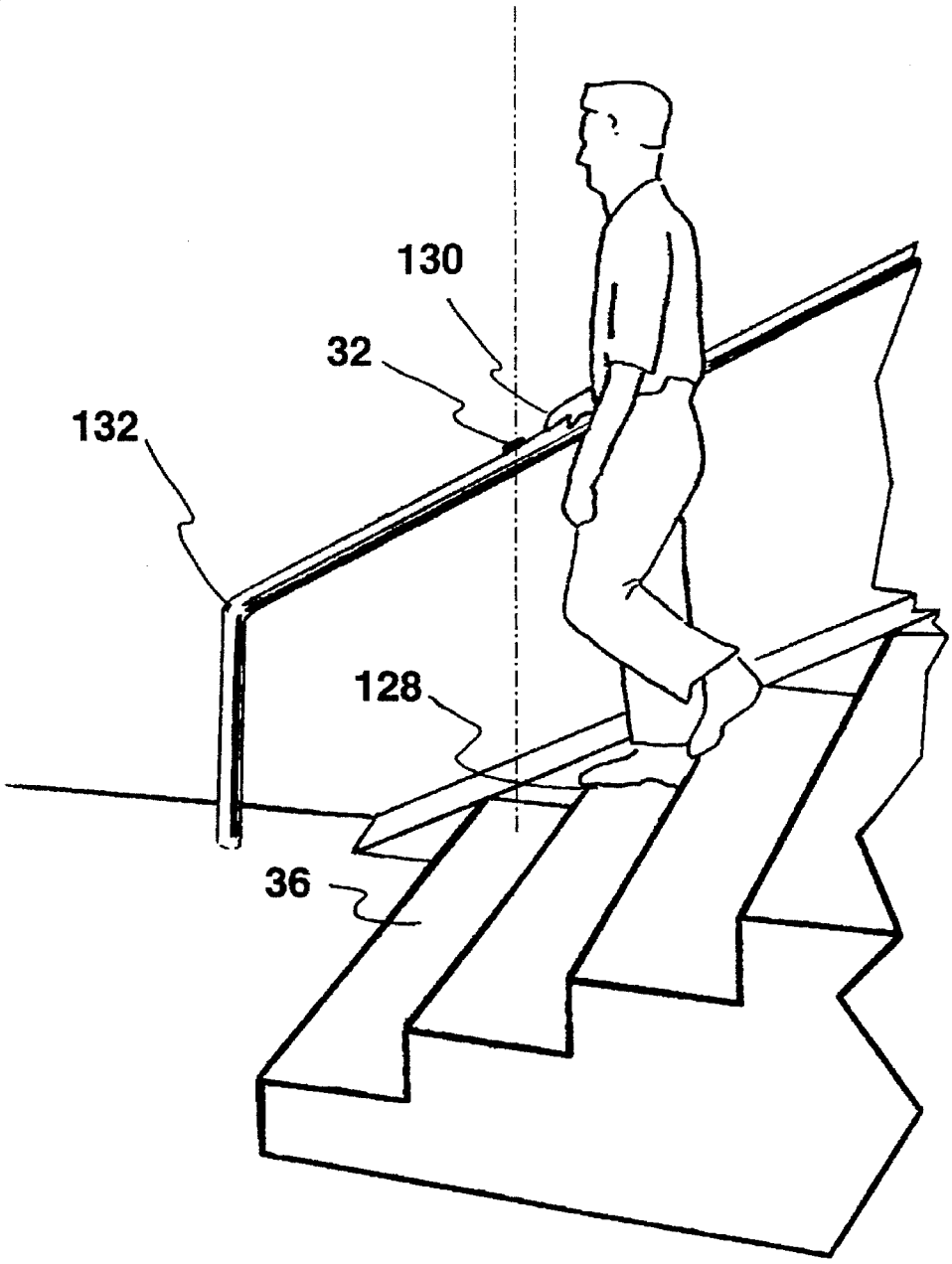
FIG. 9 is an oblique, side view showing the last-step indicator in use with an approaching pedestrian.
Figure 10:
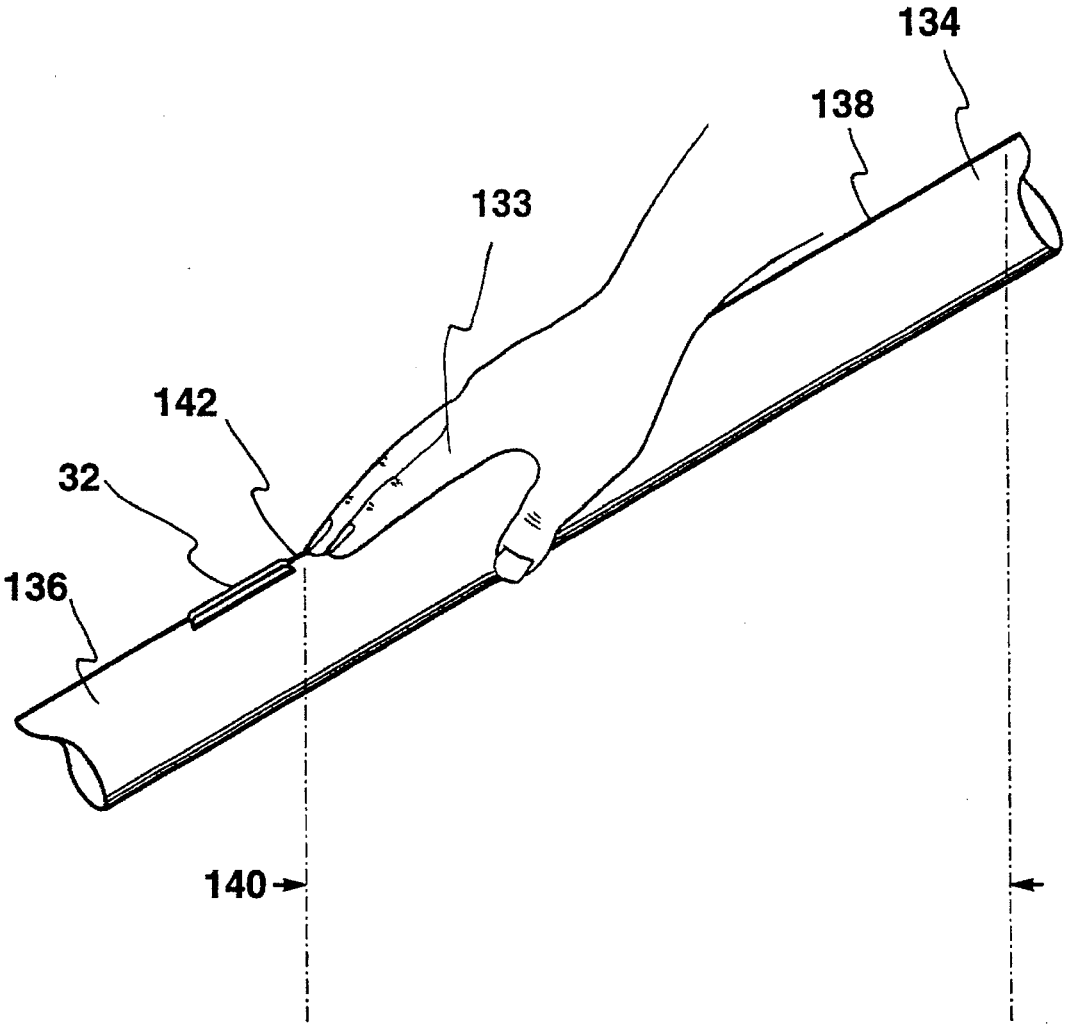
FIG. 10 is a close-up view of a pedestrian's hand sliding along a handguide just before encountering the last-step indicator.

FIGS. 9 and 10

The installed last-step indicator 32 in FIG. 9 is being approached by a pedestrian during staircase descent. This oblique view illustrates a relative foot position 128 with regard to a hand position 130 prior to the pedestrian's hand coming into contact with indicator 32. A typical handguide bend 132 is located in an area beyond next-to-bottom step 36.

A pedestrian hand 133 sliding along a handguide just before encountering the last-step indicator is shown in the close-up view in FIG. 10. Orientation of the hand illustrates, in this case, a descending movement. The hand is guided in a right-to-left, downward angle along the handguide in the direction from a high-point 134 toward a low-point 136. A uniform handguide surface 138 is provided along a dimension 140. Last-step indicator 32 is shown just beyond location 142.

OPERATION

Pedestrian Encounter and Tactile Discernment of Indicator

The pedestrian's hand position 130, on the handguide in FIG. 9, is seen just before he or she reaches indicator 32 and next-to-bottom step 36. The pedestrian, whose foot position 128 is one step above the next-to-bottom step, will reach indicator 32 the moment he or she reaches next-to-bottom step 36. A handguide bend 132, which is located beyond the stairs, provides no advance warning. Consequently, handguide bends are of little use from a last-step safety standpoint.

The pedestrian hand 133 in FIG. 10 is seen moving right to left from high point 134 to low point 136 along the smooth, uniform handguide surface 138. With the hand sliding along the consistent surface of the handguide, a staircase user quickly develops a familiarity with that specific surface. Because the hand is accustomed to the uniform surface along most of the handguide, illustrated as dimension 140, it is able to easily detect a dissimilarity in the surface texture. Surface texture is perceived by the hand to change directly after location 142 when indicator 32, a uniquely-styled protuberance, is touched.

DESCRIPTION

Three-Axis Design and Narrow Elements Permit Universal Mounting

FIGS. 11, 12A, 12B, and 12C

Figure 11:
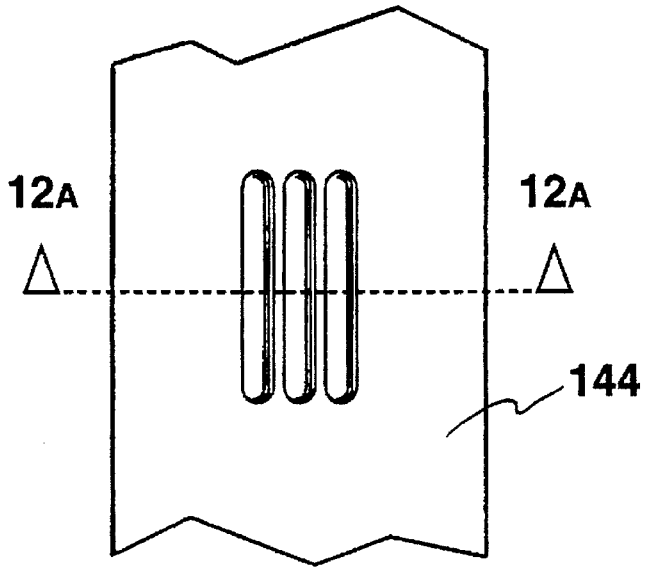
FIG. 11 shows a plan view of the last-step indicator as attached to a section of a pipe-style handguide having a convex-mount-surface profile.

An indicator attached to section of pipe-style handguide 144 is shown in plan view in FIG. 11. The mounting orientation of the three, side-by-side elements is in a longitudinal direction that parallels the handguide. A handguide cross-section line 12A—12A is detailed in FIG. 12A.

Figure 12A:
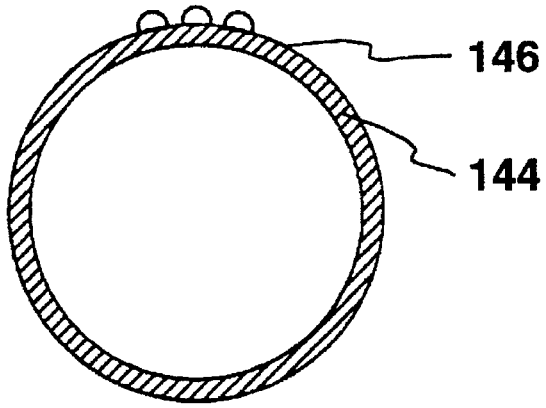
FIG. 12A is a detail sectional view taken in the direction indicated by section line 12A—12A in FIG. 11.

A cross-sectional detail in FIG. 12A shows the indicator mounted on a pipe-style handguide, which has a convex-mount-surface profile 146.

Figure 12B:
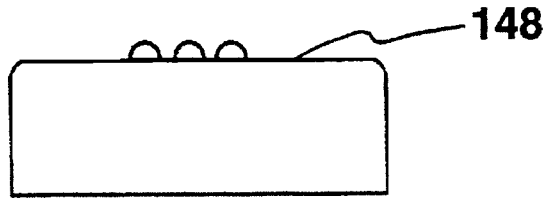
FIG. 12B is a sectional view of the last-step-indicator attached to a handguide having a flat-mount-surface profile.

The indicator, when mounted on a handguide having a flat-mount-surface profile 148, is shown in the sectional detail in FIG. 12B.

Figure 12C:
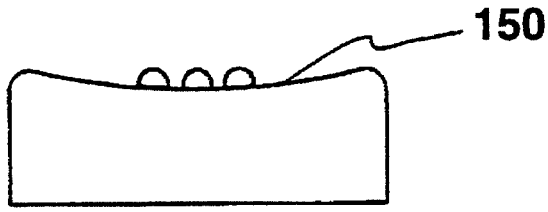
FIG. 12C is a sectional view of the last-step-indicator attached to a handguide having a concave-mount-surface profile.

The indicator, when mounted on a handguide having a concave-mount-surface profile 150, is illustrated in the sectional detail in FIG. 12C.

OPERATION

Three-Axis Design and Narrow Elements Permit Universal Mounting

The design of the indicator facilitates installation on any handguide-profile surface. The three-axis indicator is able to accommodate various profiles, including convex, flat, and concave. The indicator (whose length dimension parallels handguide direction) in FIG. 11 is shown on a small segment of pipe-style handguide. This handguide is a convex-mount surface 146 as shown in FIG. 12A. Conversely, if an indicator were composed of a single wide-element, its wide flat base would not fully contact such a curved surface. Three-axis indicators are shown accommodating other handguide surface profiles, including a flat-mount surface 148 in FIG. 12B and a concave-mount surface 150 in FIG. 12C. Individually, each element has a small footprint to contact the handguide surface. Collectively, however, grouped, multiple elements permit the stair user's hand to perceive the many elements as a whole, covering a supposedly larger area than the actual footprint of contact. Last-step indicators provide a wide-profile tactile cue yet easily conform to curved handguide profiles for effective retrofitting.

DESCRIPTION

Circumstances Dictating Use of Three and Four-Element Indicators

Figure 13A:
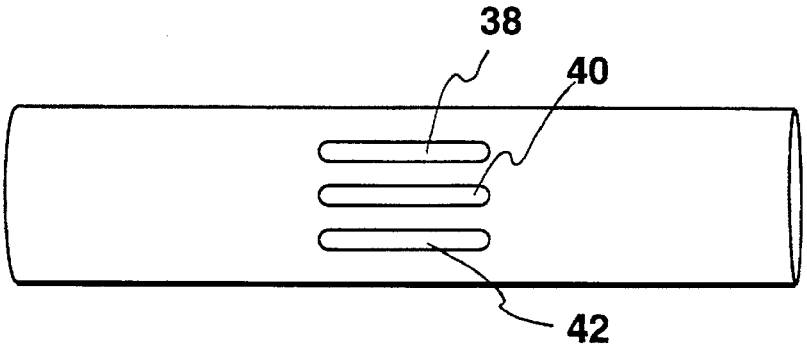
FIG. 13A shows a plan view of the last-step indicator, mounted on a section of handguide, in its three-element configuration from FIG. 4.
Figure 13B:
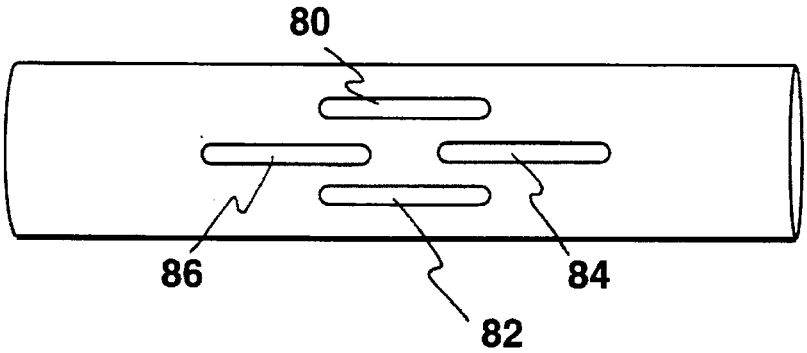
FIG. 13B shows a plan view of the last-step indicator, mounted on a section of handguide, in its four-element configuration from FIG. 5.

FIGS. 13A and 13B

A three-element configuration of the last-step indicator on a small section of handguide is shown in plan view in FIG. 13A. Elements 38, 40, and 42 are aligned evenly, side-by-side. A four-element configuration of the last-step indicator on a small section of handguide is shown in plan view in FIG. 13B. Elements 80, 82, 84, and 86 illustrate two differences compared to the elements of FIG. 13A: (1) there are more elements in FIG. 13B; (2) the arrangement of 13B elements is unique.

Figure 14:
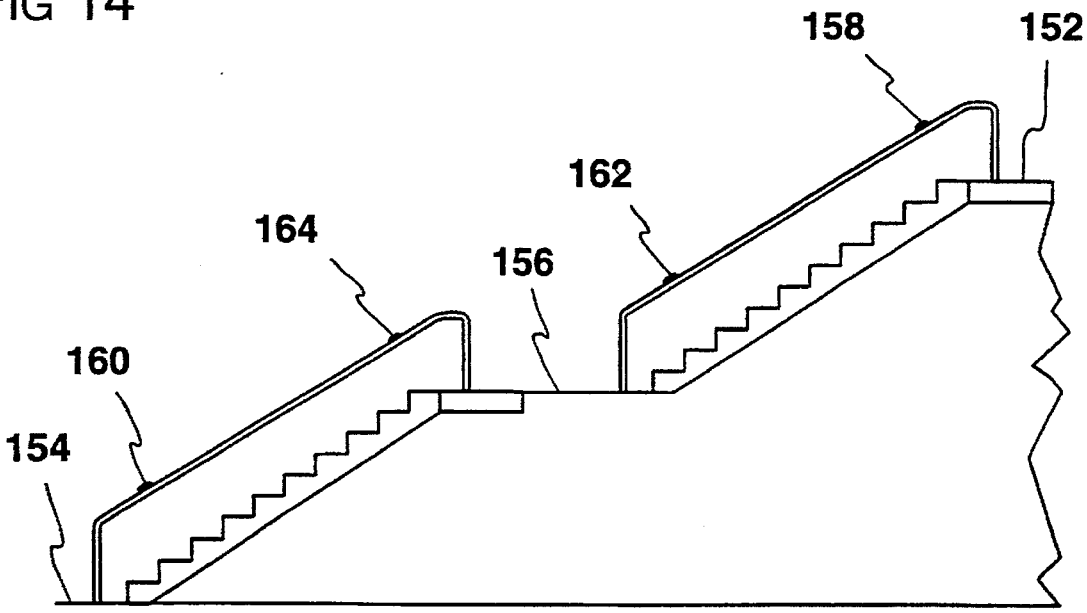
FIG. 14 shows the placement of three-element and four-element last-step indicators when multiple staircases exist.

The instances in which three-element and four-element indicators are used are illustrated in FIG. 14. Upper and lower floor levels 152 and 154 in a theoretical two-story building are separated by a double staircase which has a single midway landing 156. Upper and lower staircase three-element indicators 158 and 160 are from the type shown in FIG. 13A. Upper and lower staircase four-element indicators 162 and 164 are from the type shown in FIG. 13B.

OPERATION

Circumstances Dictating Use of Three and Four-Element Indicators

The three and four-element indicators from FIGS. 4 and 5 are shown mounted on a segment of handguide in FIGS. 13A and 13B respectively. There are specific circumstances that dictate the prescribed use of each indicator. When descending and encountering indicator 162 on the multiple staircase shown in FIG. 14, a blind or visually-unable stair user could be under a false sense of security if only a single configuration of indicator (i.e., a three-element indicator) were to be used universally. In such a case, after safely descending and exiting this upper staircase onto landing 156, he or she could tragically enter the lower staircase unknowingly and fall. For this reason, it is very valuable to provide stair users with additional safety information when one staircase is in close proximity to another staircase.

The four-element indicator from FIG. 13B serves this purpose. Not only does it indicate an upcoming last step, it is recognized as a value-added indicator, offering additional information. Its presence, when detected, signifies, as well as a staircase's last step, that another set of stairs is about to be encountered. The recognizable pattern of the four-element indicator serves to express the additional warning. Consequently, the four-element version from FIG. 13B is used for indicators 162 and 164 so that the presence of the adjacent staircase can be communicated. This, in turn, facilitates a safe encounter by the pedestrian. Thus, it permits the stair user, who exits one staircase onto landing 156, to be apprised, upon exiting, that there is another adjacent staircase nearby. Alternatively, because no adjacent staircases lie ahead of stair users who reach levels 152 and 154, the standard three-element version from FIG. 13A is used for indicators 158 and 160. Upon detection, indicators 158 and 160 simply convey the approaching end of a staircase while indicators 162 and 164 convey the approaching end of a staircase and the close proximity to the entrance to another staircase.

DESCRIPTION

Template for Installing Indicator Elements

FIGS. 15, 16, 17, and 18A

Figure 15:
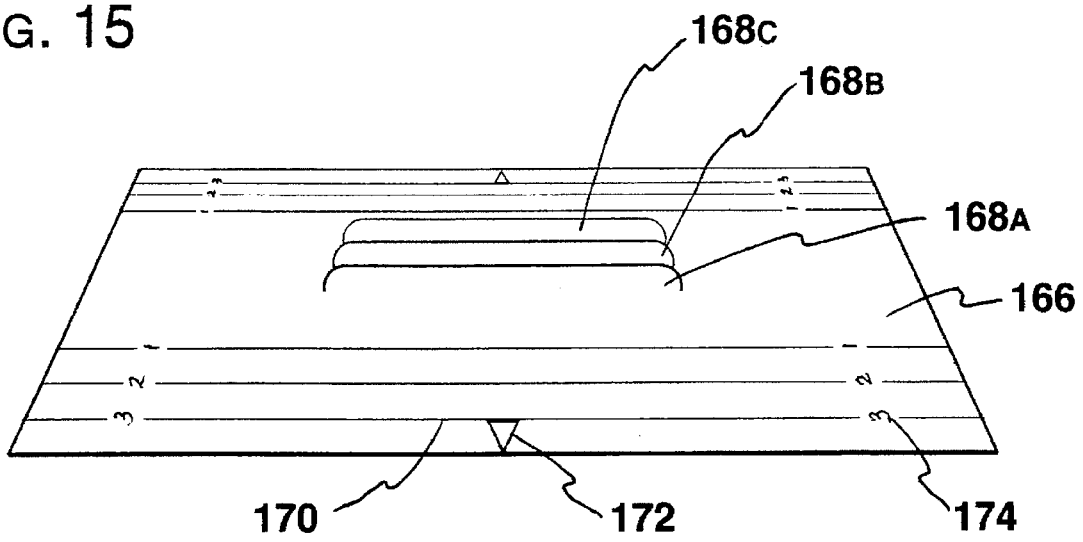
FIG. 15 is an oblique view of a mounting template that is used to install the last-step indicator on a handguide.

An installation template is shown in an oblique view in FIG. 15. The template is a thin, single-piece, semi-rigid material, such as thermoformed-plastic. It has a flexible, flat surface 166 and several elongated dome-shaped blisters, as shown by blisters 168A, 168B, and 168C. Printed, embossed, or inscribed around the sides are line, triangle, and numeric reference markings 170, 172, and 174.

Figure 16:
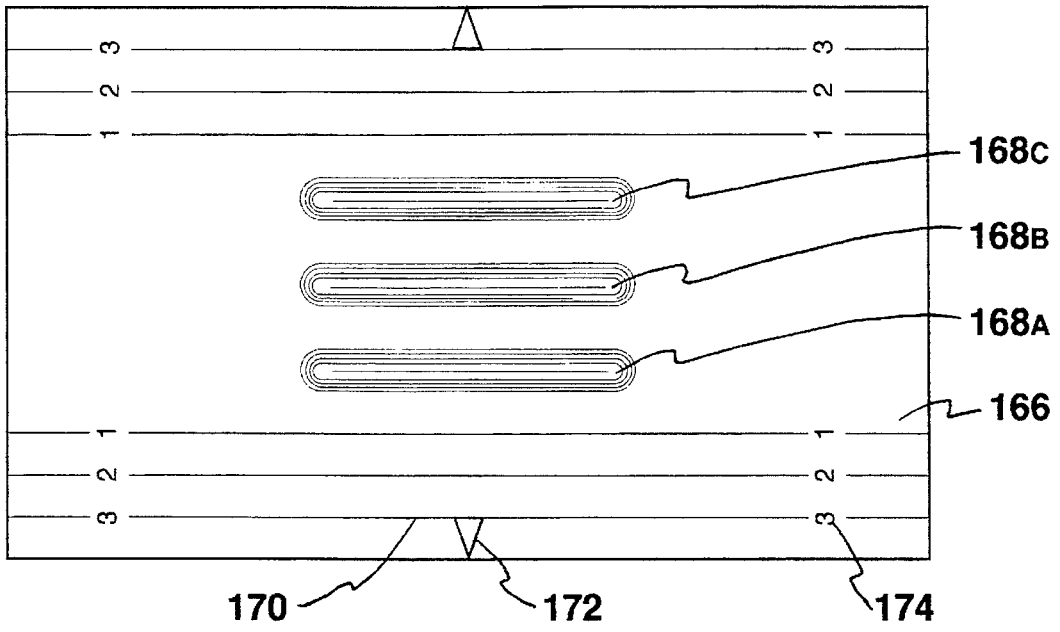
FIG. 16 is a plan view of the top surface of the installation template.

The top surface of the installation template shows, in plan view in FIG. 16, flat surface 166, three blisters 168A, 168B, and 168C, and markings 170, 172, and 174.

Figure 17:
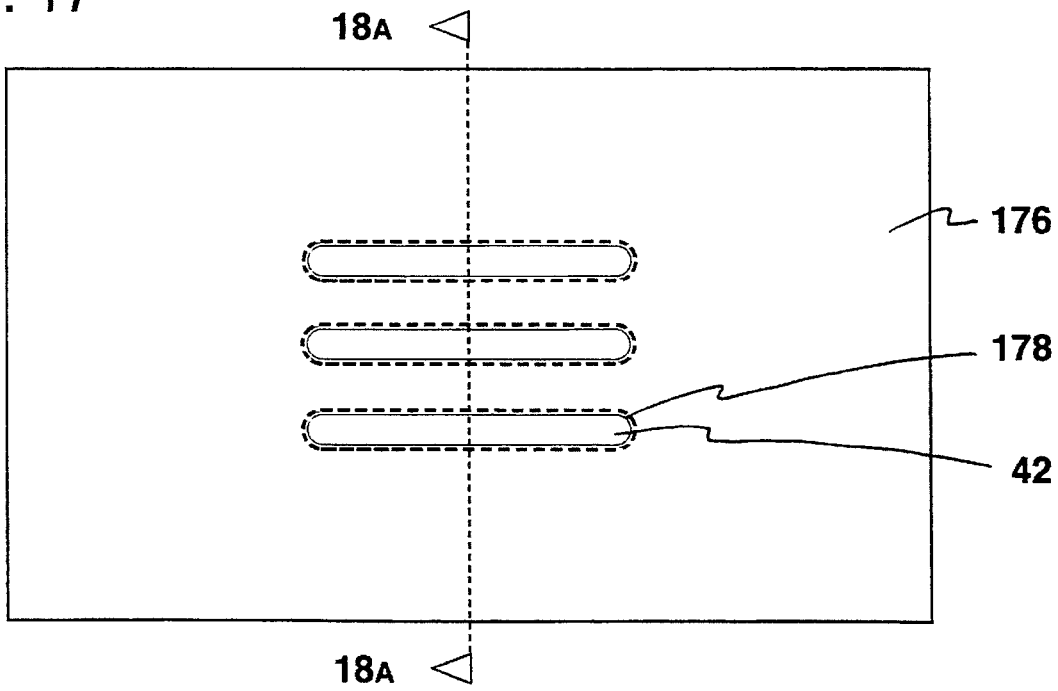
FIG. 17 is a plan view of the bottom surface of the installation template.

The bottom surface of the installation template is illustrated in plan view in FIG. 17. In order to adequately show underside details, a release sheet, which normally covers an underneath surface 176 has been removed in this FIG. A retaining edge, such as edge 178 which holds element 42 within the blister recess, encircles the edge of each blister recess. A template cross-section taken at line 18A—18A is detailed in FIG. 18A.

Figure 18A:
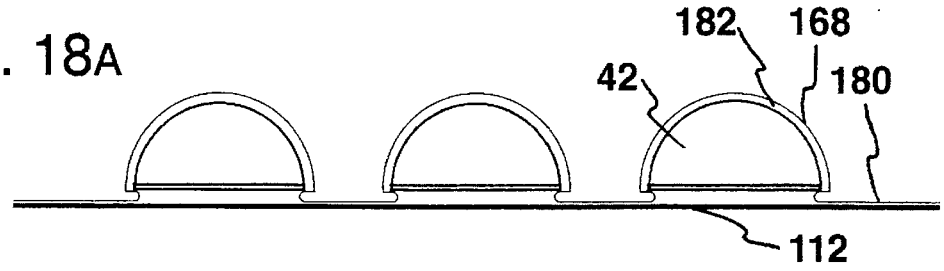
FIGS. 18A through 18H show, in sectional detail and in step sequence, the function of the template during installation of the last-step indicator elements.

An exploded cross-sectional detail is shown in FIG. 18A. Within template 180, each element, including element 42, is encased by a blister recess, such as a recess 182 of blister 168A. Release sheet 112 (which is shown as having been removed in FIG. 17) covers all underneath surfaces.

OPERATION

Template for Installing Indicator Elements

A template that is used for installing or mounting the elongated elements on handguides is shown in FIGS. 15, 16, 17, and 18A. It is typically a thermoformed, flexible plastic part. Because the template has a relatively thin dimension, surface 176 in FIG. 17 can easily contour around or conform against any designated handguide profile. The template has a series of blisters, in this case three, each of which contains a single indicator element. To assist with accurate positioning of the indicator elements, surface 166, in FIGS. 15 and 16, provides line, triangle, and numeric reference markings 170, 172, and 174. When an installation person views the template against the handguide front a position that is directly above the template, he or she can use these markings to easily center and align the device for precise placement on the handguide.

The underside of the template in FIG. 17 is shown with the release sheet having been removed. Retaining edge 178 is of a dimension that is slightly smaller in circumference than the circumference dimension of element 42's edge. Consequently, the retaining edge confines and holds the element within the blister.

Each of the three elements in FIG. 18A are contained within their respective blisters of template 180 and are encased by release sheet 112. Blister 168A contains element 42 within its own blister recess 182.

DESCRIPTION

Seven Stages During Installation
FIGS. 18B to 18H

Seven successive steps during indicator installation using the template are illustrated in FIGS. 18B through 18H. A detailed progression of the installation is shown by the successive FIGS.

Figure 18B:
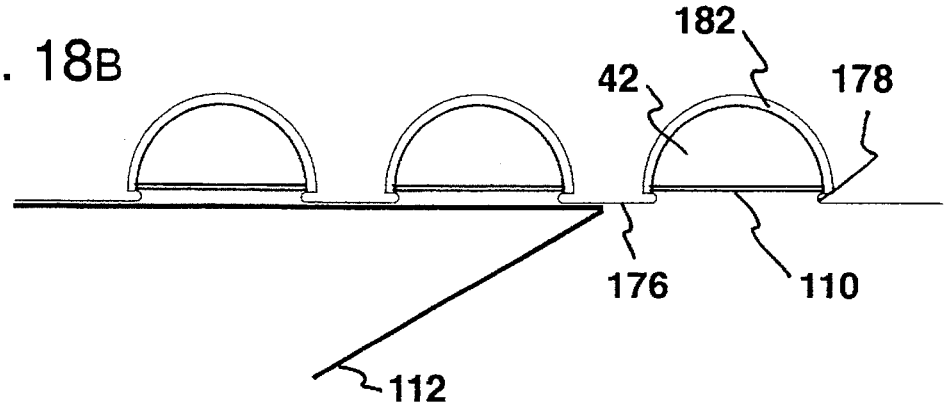

Sheet 112, in FIG. 18B, is shown in the process of being peeled away from surface 176. Element 42, with exposed surface 110, is held within recess 182 by edge 178.

Figure 18C:
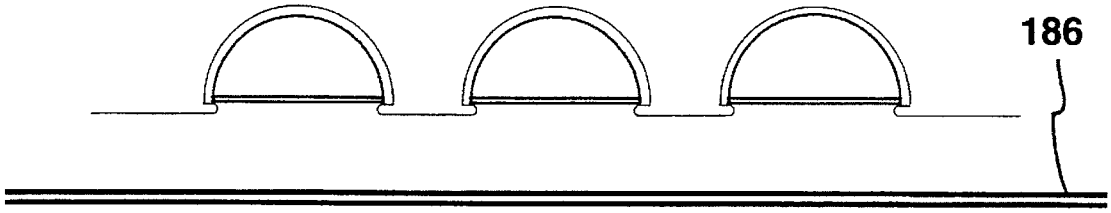

The template, in FIG. 18C, retains, with its blisters, the exposed elements which are being positioned over a mount-surface 186.

Figure 18D:
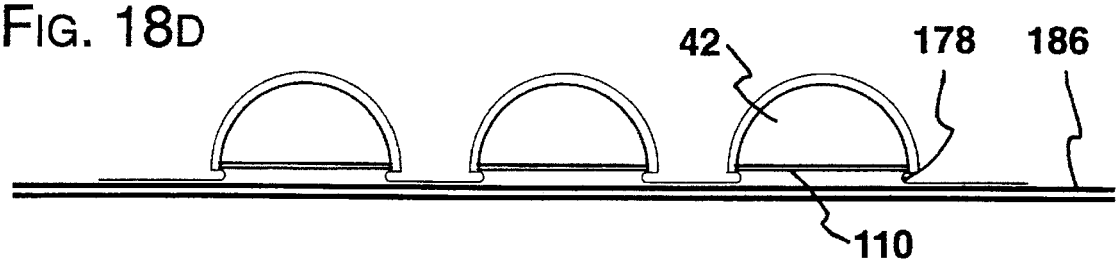

The template, in FIG. 18D, is shown as it contacts surface 186. Edge 178 keeps adhesive surface 110 of element 42 above surface 186.

Figure 18E:
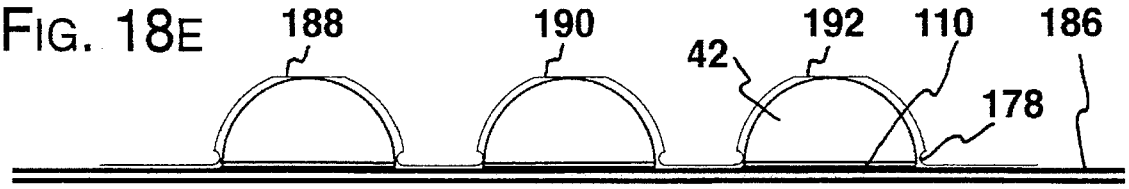

Left, central, and right dome points 188, 190, and 192 in FIG. 18E are shown flattened by a downward force against each respective element. The flat adhesive surface of each element is shown pushed down to a horizontal level that is below the elements' respective retaining edges, as is evidenced by element 42 having been pushed past edge 178. Adhesive surfaces of all elements, such as surface 110, are shown in contact with mount-surface 186.

Figure 18F:
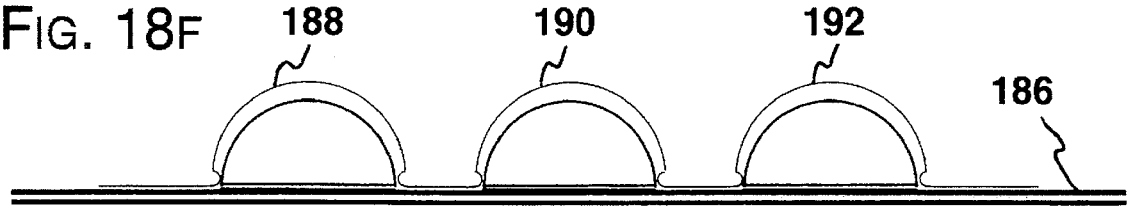

The template, in FIG. 18F, is shown with unflattened points 188, 190, and 192 and with all three elements remaining on mount surface 186.

Figure 18G:
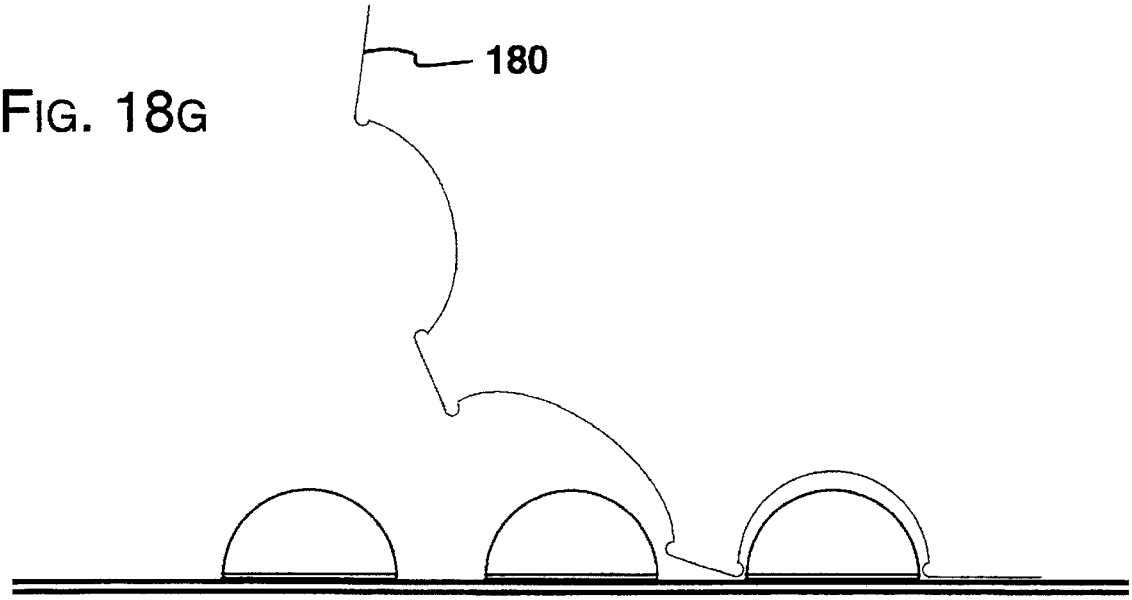

Template 180, in FIG. 18G, is shown partially removed.

Figure 18H:
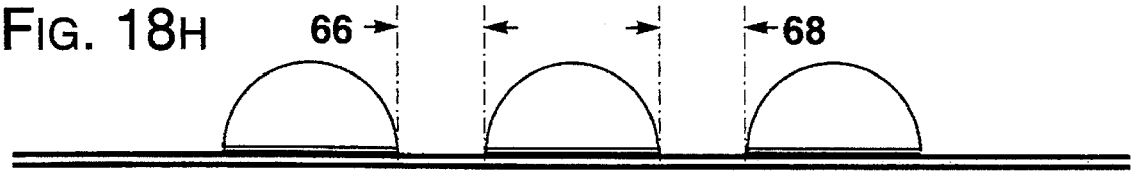

Mounted elements, after complete removal of the template, are shown in FIG. 18H in alignment with uniform spaces 66 and 68.

OPERATION

Seven Stages During Installation

Seven successive stages of an installation are seen in FIGS. 18B through 18H as the template is prepared, positioned, compressed, and removed. Template "preparation" is illustrated in FIG. 18B. Release sheet 112 is being peeled back and away, exposing the template's underneath surface 176 and adhesive mount surface 110 of element 42. Because the circumference dimension of retaining edge 178 is smaller than the circumference dimension of the element's outside edge, edge 178 holds element 42 (having the larger circumference dimension) within blister recess 182. The template and elements in FIG. 18C are shown being lowered onto designated mount surface 186. The template, in FIG. 18D, is shown contacting the mount surface. Because retaining edge 178 is able to hold element 42 within the blister, adhesive mount surface 110 is still suspended above mount surface 186. This allows the template to be adjusted and positioned (by the installer with the aid of reference markings 170, 172, and 174 in FIG. 16) for precise placement. After positioning is finalized, pressure, such as by a hand or thumb of the installer, is exerted on left, central, and right-dome points 188, 190, and 192 of the blisters shown in FIG. 18E. This pressure causes the elements to slip past their respective retaining edges, because the template is semi-rigid and can flex. After pressure is released from the dome points, as shown in FIG. 18F, the elements are seen having been bonded successfully to mount surface 186. From this point on, there is no further use for the template. Template 180 in FIG. 18G is shown in the process of being peeled up and off of the mounted elements. It is discarded. All elements are not only mounted, they are aligned and oriented in a way that is uniform and exact. Spaces 66 and 68, shown in FIG. 18H, are equal and proportionate.

Alternative Versions of Invention
FIGS. 19A to 28B

Handguide indicators and an installation device, illustrated in FIGS. 19A through 28B, serve as alternative examples to the preferred embodiments discussed and included in FIGS. 1 through 18H.

DESCRIPTION

Figure 19A:
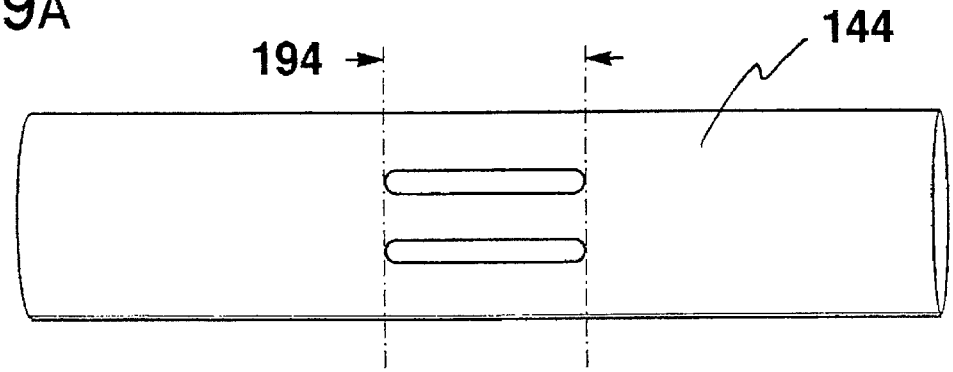
Figure 19B:
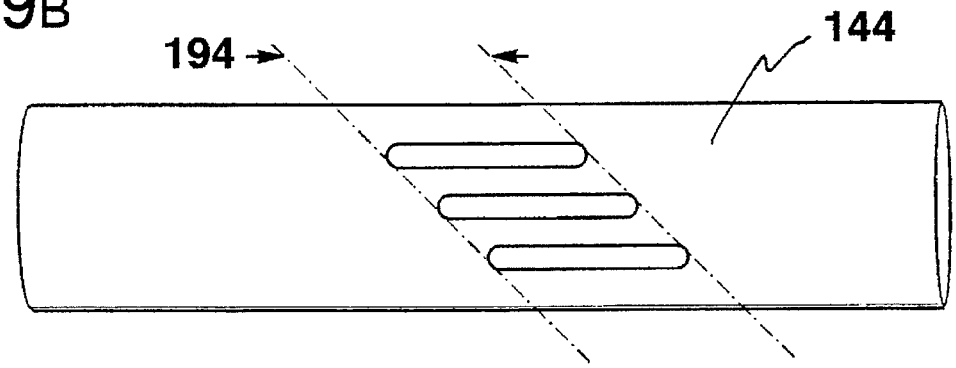
Figure 19C:
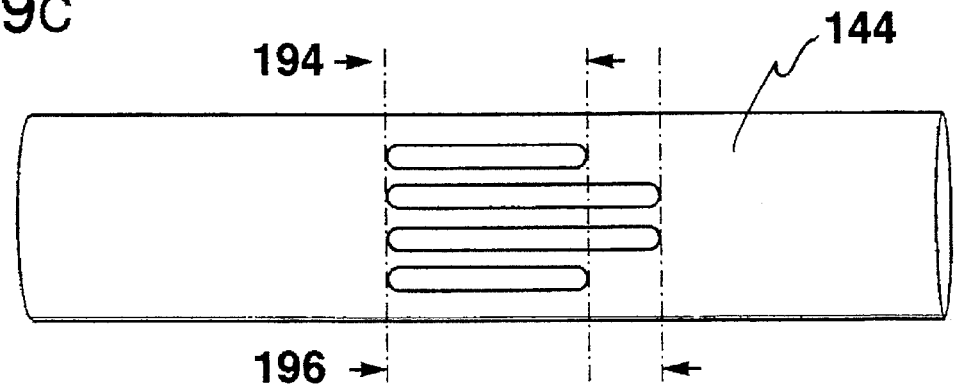

Elongated Element Configurations
FIGS. 19A, 19B, and 19C

FIG. 19A shows a segment of handguide 144 in plan view with two side-by-side, parallel elements, of a single length 194, whose ends align in a direction that is perpendicular to the direction of the handguide.

FIG. 19B shows a segment of handguide 144 in plan view with three parallel, diagonally-offset elements of length 194.

FIG. 19C shows a segment of handguide 144 in plan view with four side-by-side, parallel elements, two with length 194 and two with a longer length 196.

OPERATION

Elongated Element Configurations

Examples of three alternative configurations of elongated elements are shown in FIGS. 19A through 19C. Each indicator configuration illustrates differing numbers and orientations of elements that are distinctive.

Although the device is shown previously as specifically arranged elements in three-dement and four-element configurations, it can include, but not be limited to, other possible arrangements of elongated elements in regards to orientation and number. For instance, as shown in FIG. 19A, there are only two elongated elements, of single length 194, whose ends align in a direction that is perpendicular to the direction of the handguide. As shown in FIG. 19B, there are three elements of single length 194, whose ends align in a direction that is diagonal to the direction of the handguide. As shown in FIG. 19C, there are four elements, two of which have a single length 194 and two of which have a longer length 196. These three designs are meant to serve only as examples of the wide variety of possible configurations.

DESCRIPTION

Dome-Shaped Element with Screw

Figure 20A:
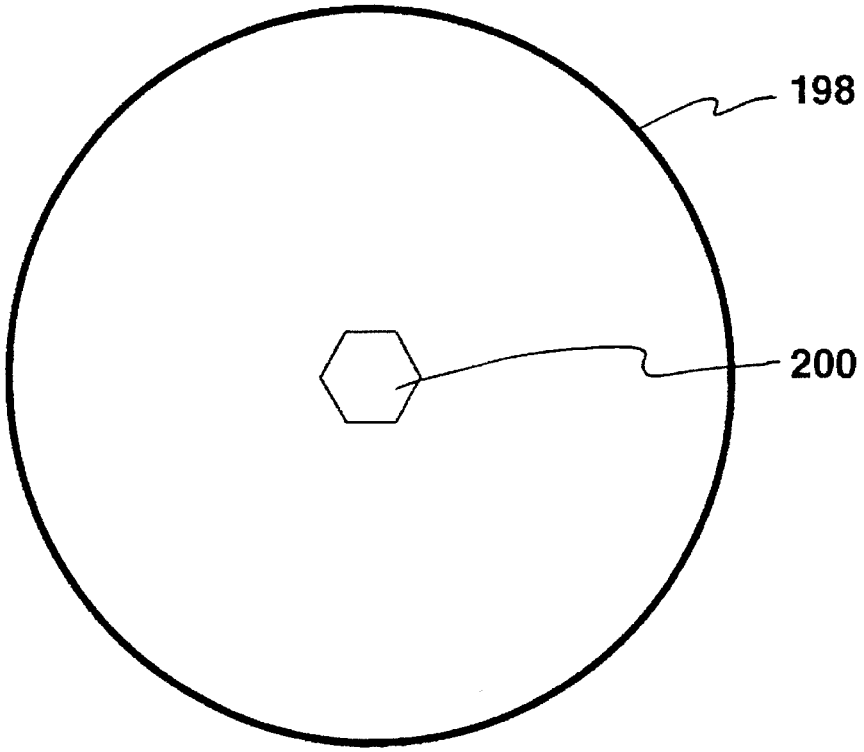
FIGS. 20A and 20B show a half-sphere, dome-shaped style of element that uses no adhesive but instead incorporates threads for installation.
Figure 20B:
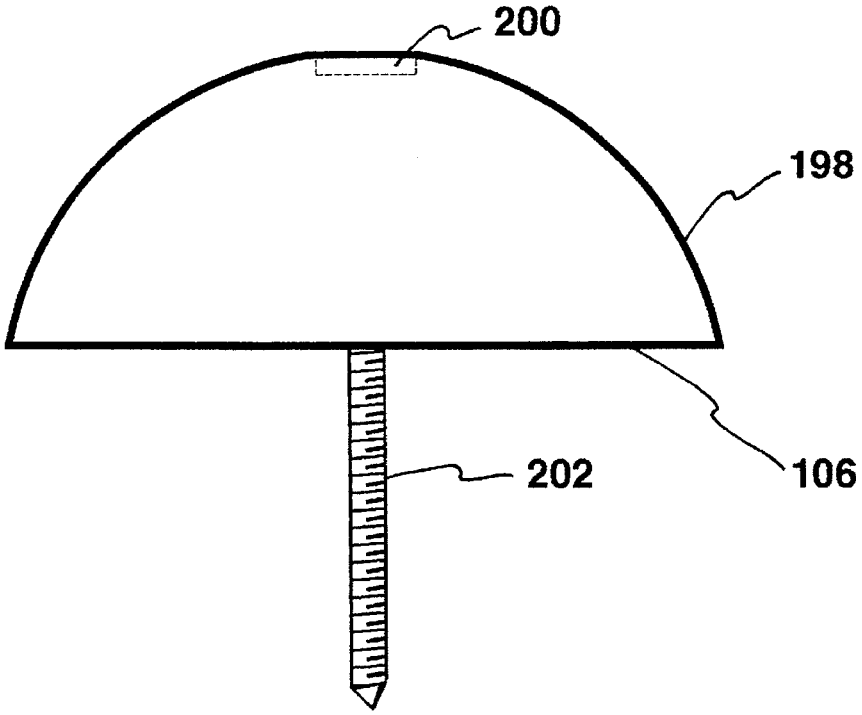

FIGS. 20A and 20B

A single, screw-type element in FIG. 20A illustrates in plan view a half-sphere, dome 198. This indicator element shows a hexagonal recess 200 at the center apex.

The element in FIG. 20A is shown in side view in FIG. 20B illustrating shape 198, recess 200, and screw 202.

OPERATION

Dome-Shaped Element with Screw

Although our last-step indicator uses elements that are elongated, it can include, but not be limited to, other shapes, such as a half-sphere or dome-shape. Such a possible dome-shape 198 is shown in FIGS. 20A and 20B In this particular case, the element uses screw 202, in place of an adhesive, for securing the element onto wood or other handguide material. The element has hexagonal recess 200 to be engaged by a suitable power tool or hand tool, such as an Allen wrench, that accommodates recess 200. As the element is turned by the engaging tool, screw 202 is driven through the handguide surface into the handguide material until it finally anchors flat base 106, of the element, securely against the exterior surface of the handguide. As opposed to a standard screwdriver slot, the less-common hexagonal recess helps dissuade vandals from tampering. However, the engaging mechanism (e.g., hexagonal recess 200 and its compatible engaging tool) can be of any design for successfully screwing a threaded element to a handguide. Such engaging mechanism can include any style of tool with compatible tool-receptacle, slot, opening, groove, hole, raised edge, etc.

DESCRIPTION

Dome-Shaped Element as a Push Rivet

Figure 21A:
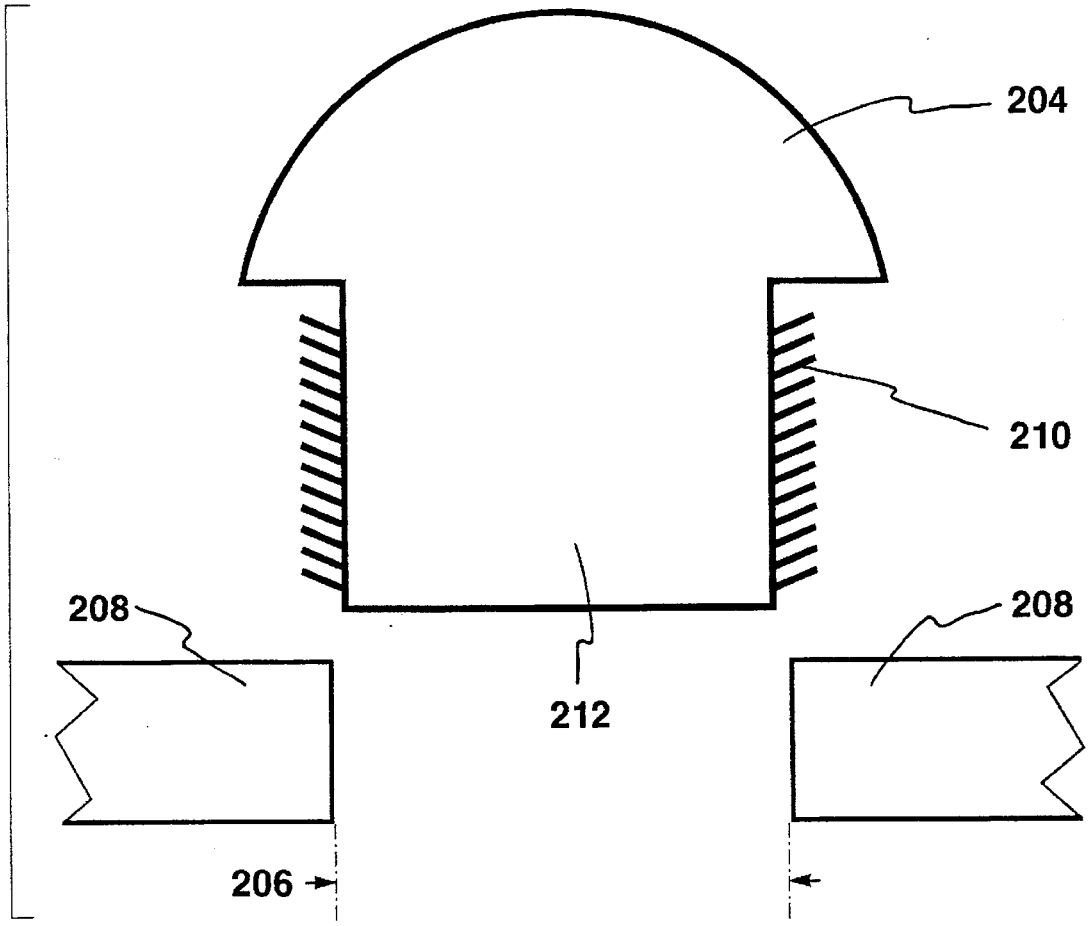
FIGS. 21A and 21B show a sectional side view of a dome-shaped push-rivet element.
Figure 21B:
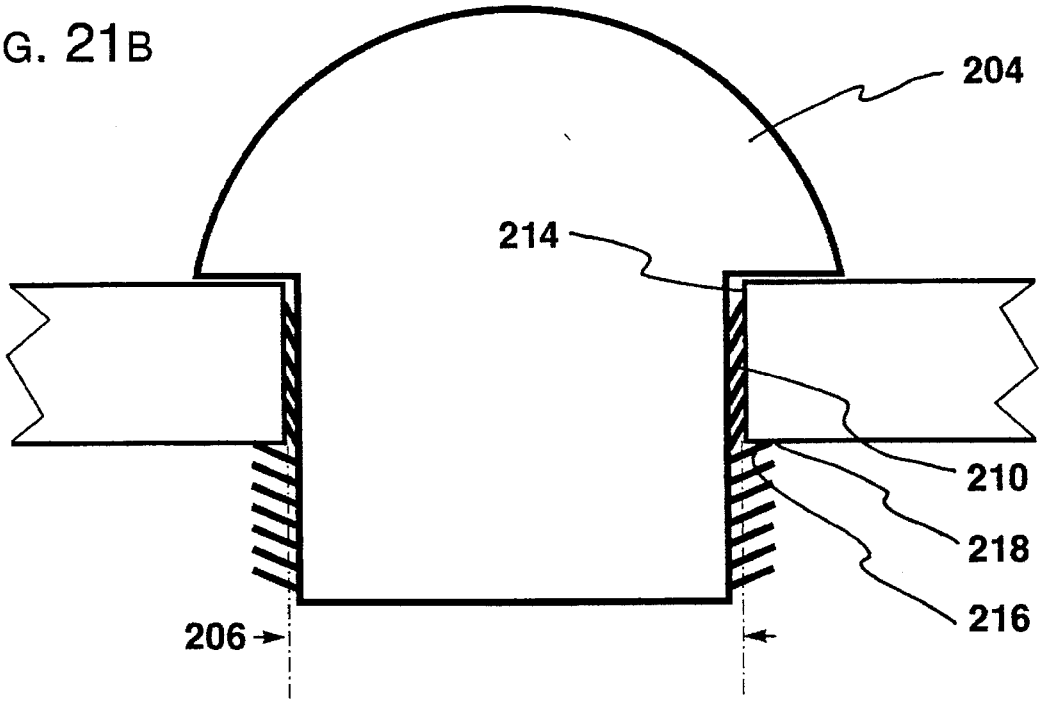

FIGS. 21A and 21B

The single indicator element in FIG. 21A shows in sectional side view a dome-shaped push-rivet 204. This element is suspended above a predrilled opening 206 that has been made in a thin-walled handguide 208. A series of angled fins, such as an upper angled-fin 210, are composed of a semi-rigid material, such as plastic, and are circumjacent to a rivet stem 212.

In FIG. 21B, rivet 204 is shown after insertion into opening 206. Upper fins, including fin 210, are shown compressed against a wall surface 214 of opening 206. Lower angled-fins, such as a fin 216, are shown in their previously extended orientation (original position). Fin 216 is shown contacting a handguide opening-edge 218.

OPERATION

Dome-Shaped Element as a Push Rivet

An alternative to the dome-shaped screw element in FIGS. 20A and 20B is an element that is a dome-shaped push-rivet 204, as shown in FIGS. 21A and 21B. This style of element requires predrilled opening 206 to be made into thin-walled handguide 208 so that rivet stem 212 can be inserted. A series of angled-fins, such as upper angled-fin 210, encircle stem 212. The design of these fins allows them to be flexible in a limited way. These fins are able to compress upwardly against stem 212 when force is applied against the bottom surface of the fins. However, the fins are not able to flex downwardly beyond their original extended orientation. Therefore, fins may compress upwardly and may decompress back to original position but may never compress downwardly beyond original position. After stem 212 of push-rivet 204 has been inserted into opening 206 in FIG. 21B, upper angled-fins, including fin 210, are shown in a compression state against wall surface 214 due to the restricting diameter of opening 206. These compressed fins provide a secure, tight "comfort fit" within opening 206. Lower fins, including lower angled-fin 216, have been pushed down past opening wall 214 and have assumed their original, uncompressed state. Since angled-fin 216 is nearest to opening-edge 218, it contacts this edge. Because fin 216 cannot compress downwardly, it locks the rivet firmly in place.

DESCRIPTION

Dome-Shaped Snap-In Element with Mating Insert

FIGS. 22A to 22D

Figure 22A:
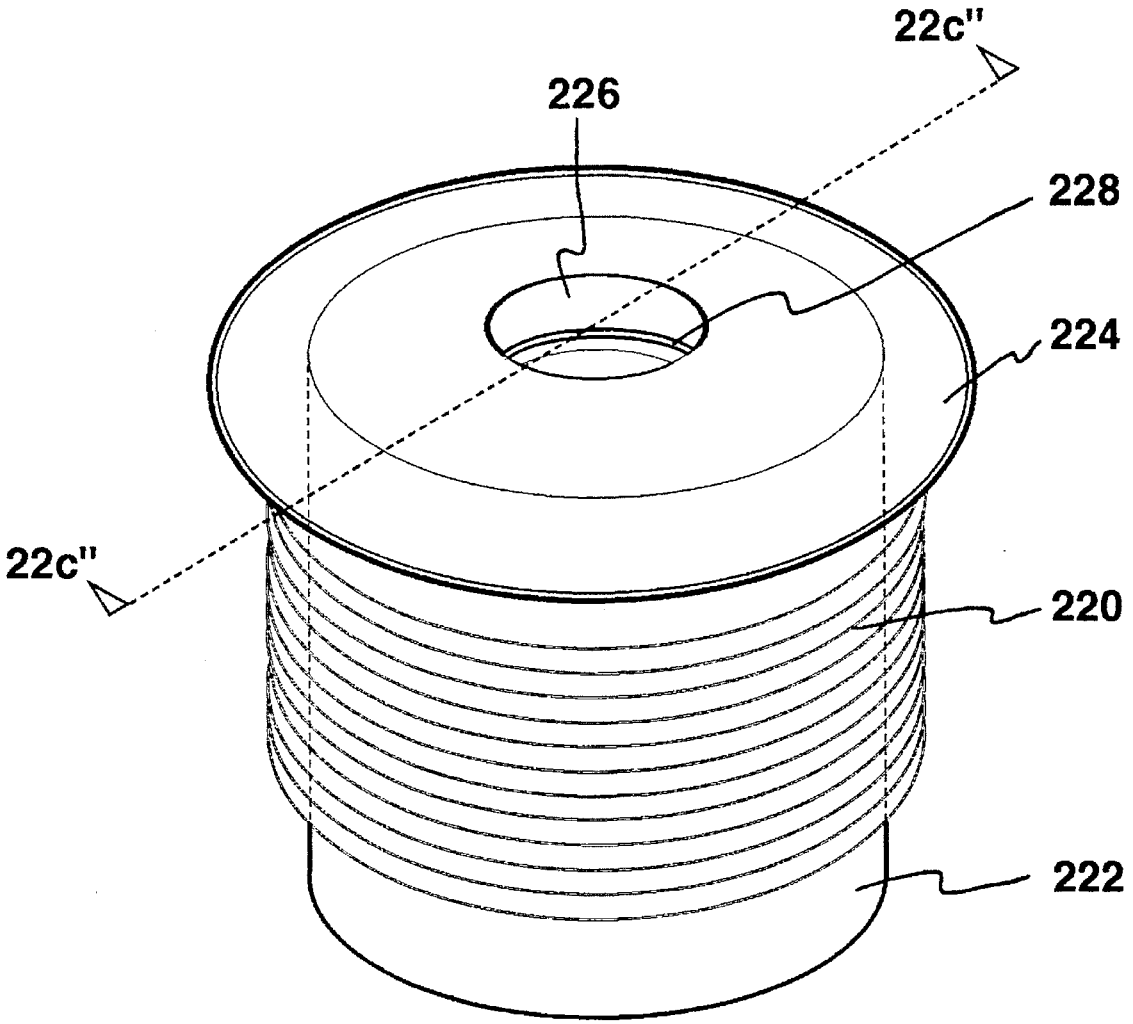
FIGS. 22A through 22D illustrate an alternative element configuration that uses a push-style insert, that is positioned in a predrilled hole, and a mating element that snaps together into the center of the insert.

FIG. 22A shows an element-insert in oblique view with fins, including an element-insert fin 220, circumjacent to a central post 222. At the top, there is a flange 224 and a snap-rivet hole 226 with a ring-shaped recess 228. Recess 228 is past of a mechanism that serves to lock a compatible, mating element into hole 226. An element-insert cross-section taken at line 22C"—22C" is detailed as a middle part 22C" in FIG. 22C.

Figure 22B:
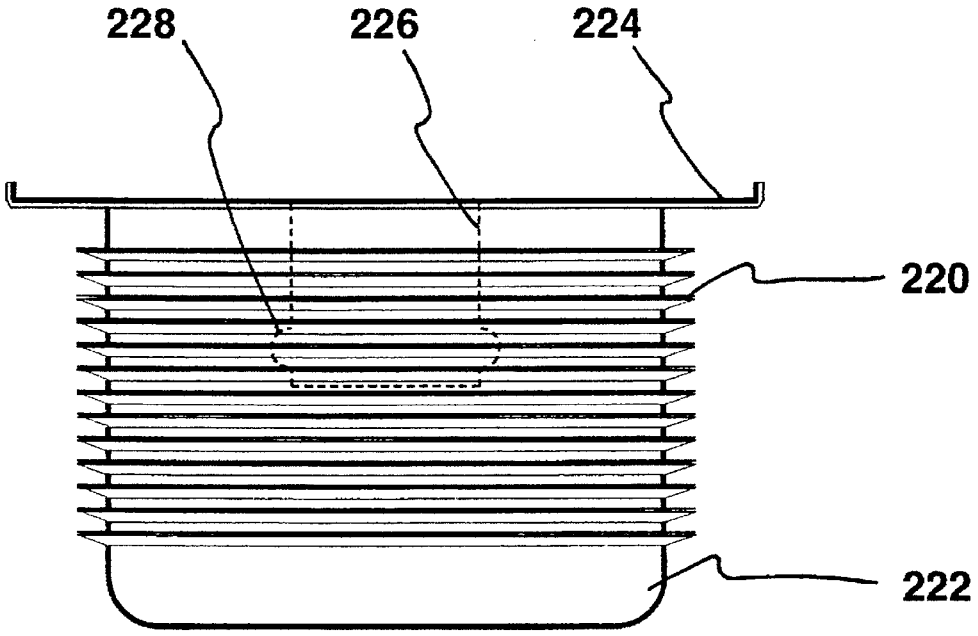

Element-insert fins, including fin 220, illustrated in side view in FIG. 22B, encircle and are tangent to central post 222. A top surface shows flange 224 and snap-rivet hole 226 with ring-recess 228.

Figure 22C:
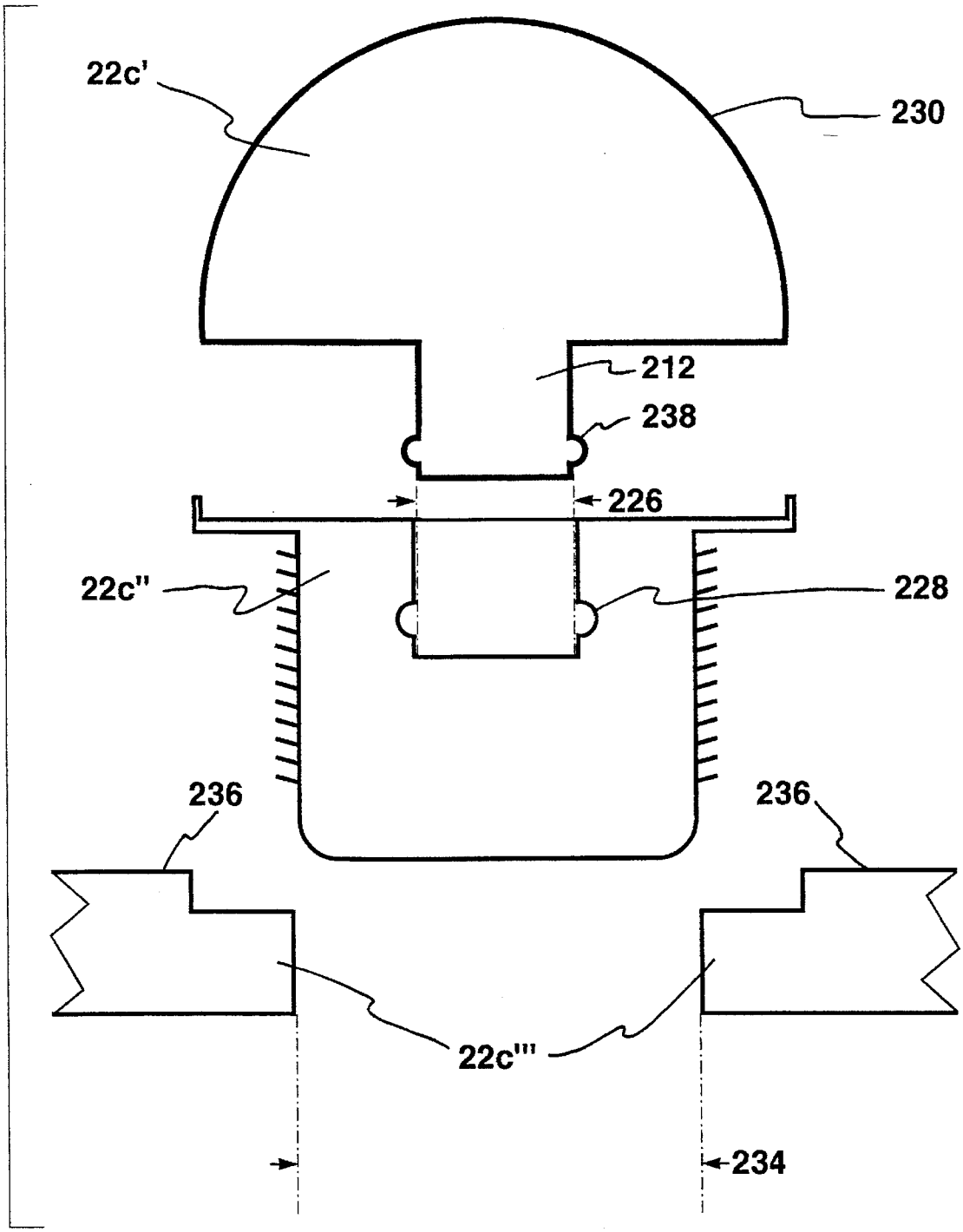

Three parts in sectional, side view are shown in FIG. 22C. A dome-shaped, snap-in element 230 with rivet stem 212 and ring-ridge 238 is shown as a top part 22C'. A cross-sectional detail of the element-insert taken in the direction indicated by section line 22C"—22C" in FIG. 22A is shown in FIG. 22C as middle part 22C". This view of the element-insert shows snap-rivet hole 226 and recess 228. Thirdly, a sectional detail of a bottom part 22C"' in FIG. 22C shows a single opening 234 that has been drilled through handguide surface 236.

Figure 22D:
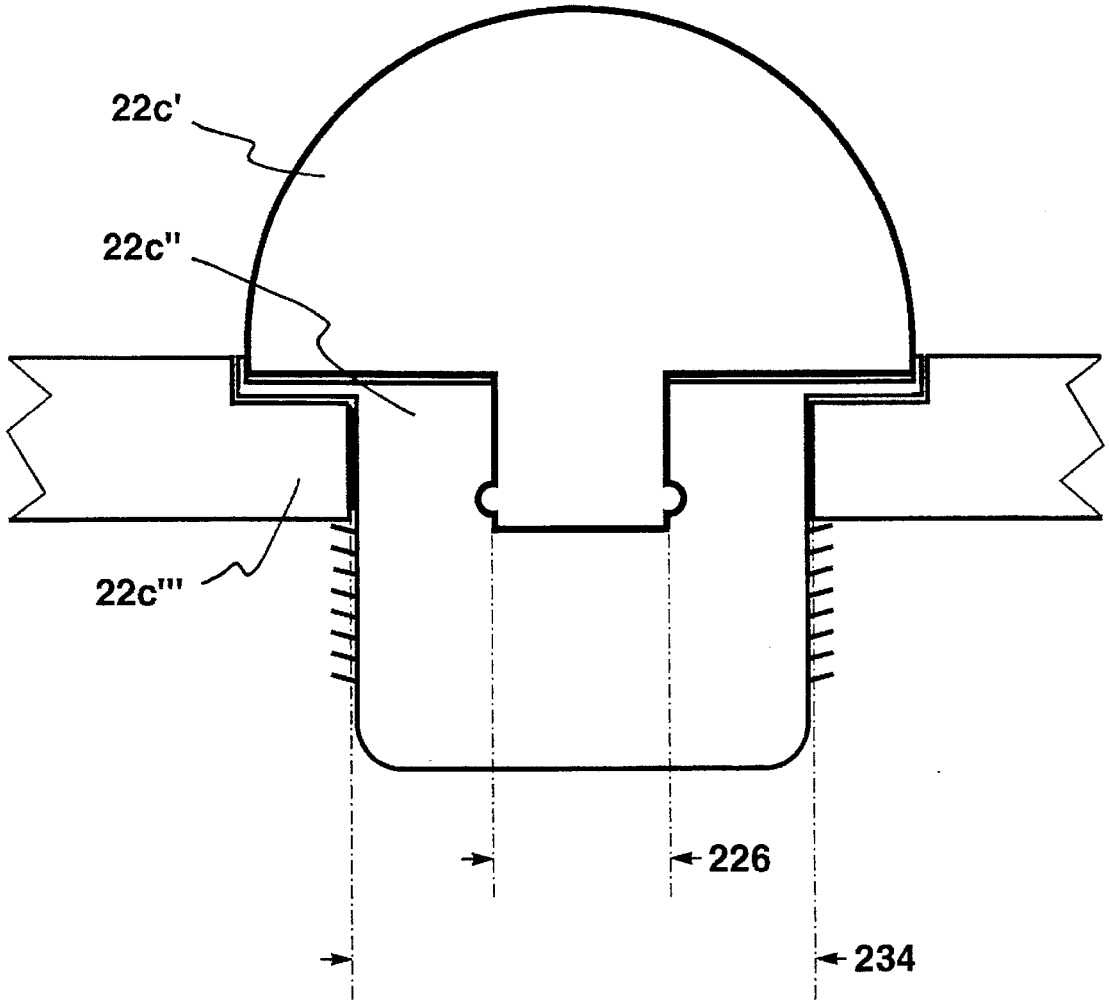

The insert or middle part 22C", in cross-sectional detail in FIG. 22D, is shown after it is pushed fully into opening 234 of bottom part 22C"'. It also shows indicator rivet or top part 22C' after it is pushed fully into hole 226 of middle part 22C".

OPERATION

Dome-Shaped Snap-In Element with Mating Insert

Another version of an element that, in this case again, is dome-shaped, is shown in FIGS. 22A, 22B, 22C, and 22D. It consists of a snap-in style element and a mating insert that receives the snap-in element.

An element-insert in FIG. 22A shows a central post 222. It has a series of angled fins, including fin 220 which encircle the central post. These fins have the same mechanical attributes as the fins described in FIGS. 21A and 21B. Flange 224 is a flat surface that provides a smooth contact surface for the base of the mating element. Hole 226 is the receiving hole for the element's rivet stem.

The insert in FIG. 22B shows the series of angled-fins, including fin 220, which encircle post 222. Angled-fins are able to compress, decompress, and lock into a predrilled opening in a handguide. Flange 224 serves to provide a compatible flat surface of sufficient diameter that, upon installation, contacts the flat base of the mating element. Hole 226 is centered at the top of the insert. Ring recess 228, along the side of the hole, serves to receive and securely hold a ring ridge that is located around the stem of a compatible, mating snap-in element.

Three parts are shown in FIG. 22C. A dome-shaped, snap-in element 230 with rivet stem 212 is shown as top part 22C'. Ring-ridge 238 is one half (the male half) of the locking mechanism that holds the element and the insert together. An element-insert with snap-rivet hole 226 is shown as middle part 22C". Ring-shaped recess 228 is the other half (the female half) of the locking mechanism that holds the element and the insert together. The composite material of the element and the insert are typically a non-brittle plastic that has some capacity to expand without breaking. Since the diameter of the element's ring ridge is larger than the diameter of the insert's snap-rivet hole, one or both components must be somewhat flexible to deform slightly during insertion. However, once the element has been forced fully into the snap-rivet hole, such as by pounding with a hammer, the ring-ridge and the ring-shaped recess mate together making removal difficult and unlikely. Single opening 234, that has been drilled through handguide surface 236, is shown as bottom part 22C'''. The diameter of opening 234 is of a sufficient size to accommodate the diameter of the insert's post and fins.

All three parts of FIG. 22C are shown assembled in FIG. 22D. The element or top part 22C' has been fitted securely into snap-rivet hole 226, and the insert or middle part 22C" has been fitted securely into opening 234 of handguide, bottom part 22C'''.

DESCRIPTION

Dome-Shaped Element as an Expansion Rivet

FIGS. 23A to 23D

Figure 23A:
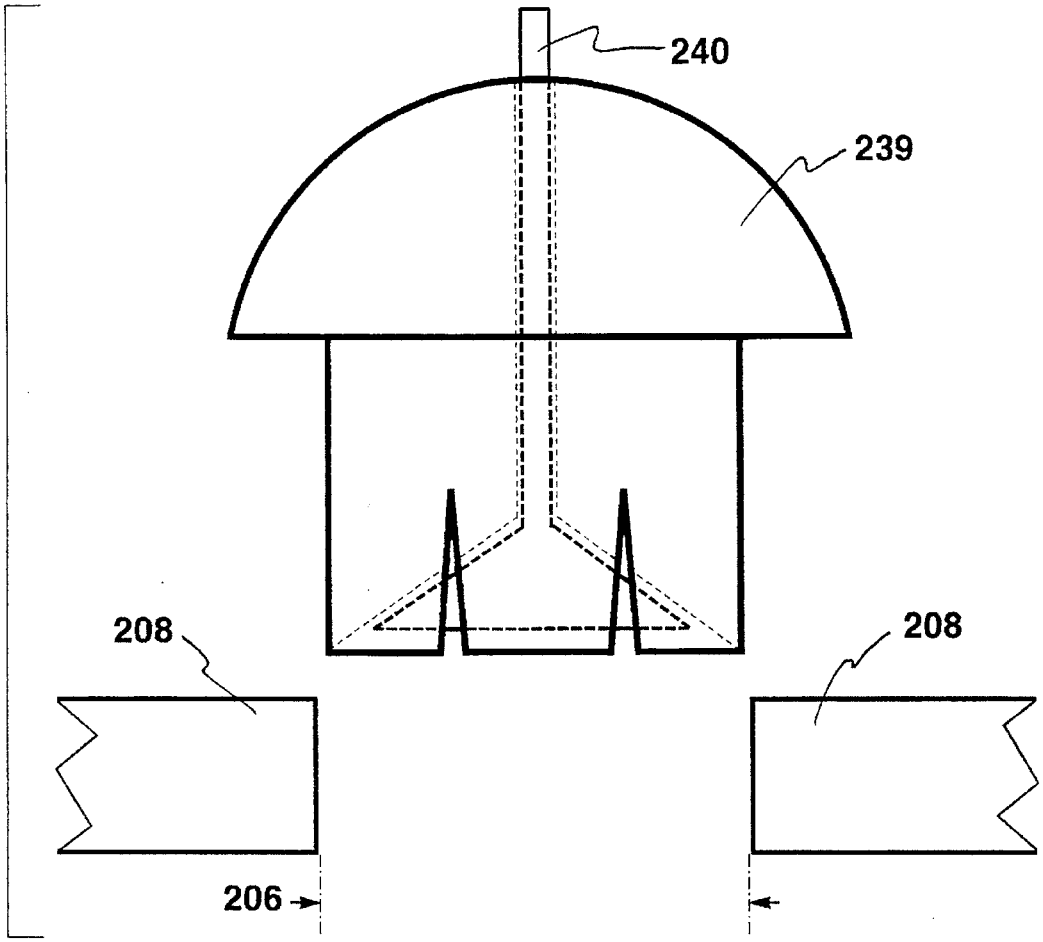
FIGS. 23A through 23D illustrate, in side view, an alternative indicator element that is an expansion rivet.

The dome-shaped, expansion element 239, shown in side view in FIG. 23A, is a rivet having central pull-stem 240. The rivet is shown positioned directly above opening 206, which is previously drilled into handguide 208.

Figure 23B:
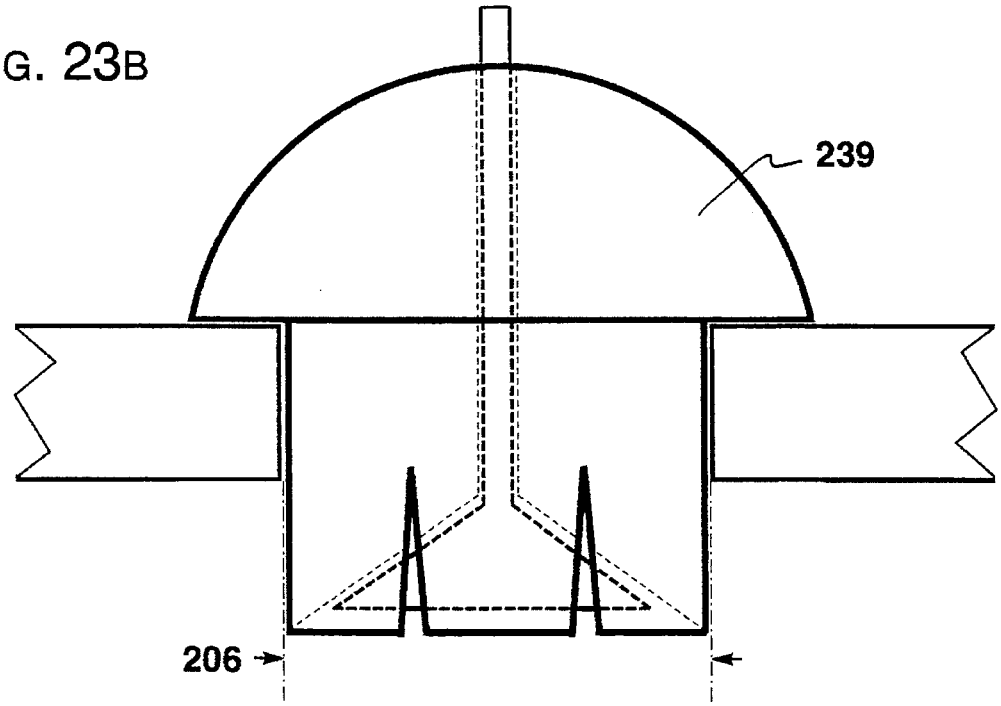

FIG. 23B shows element 239 in side view after having been inserted into opening 206.

Figure 23C:
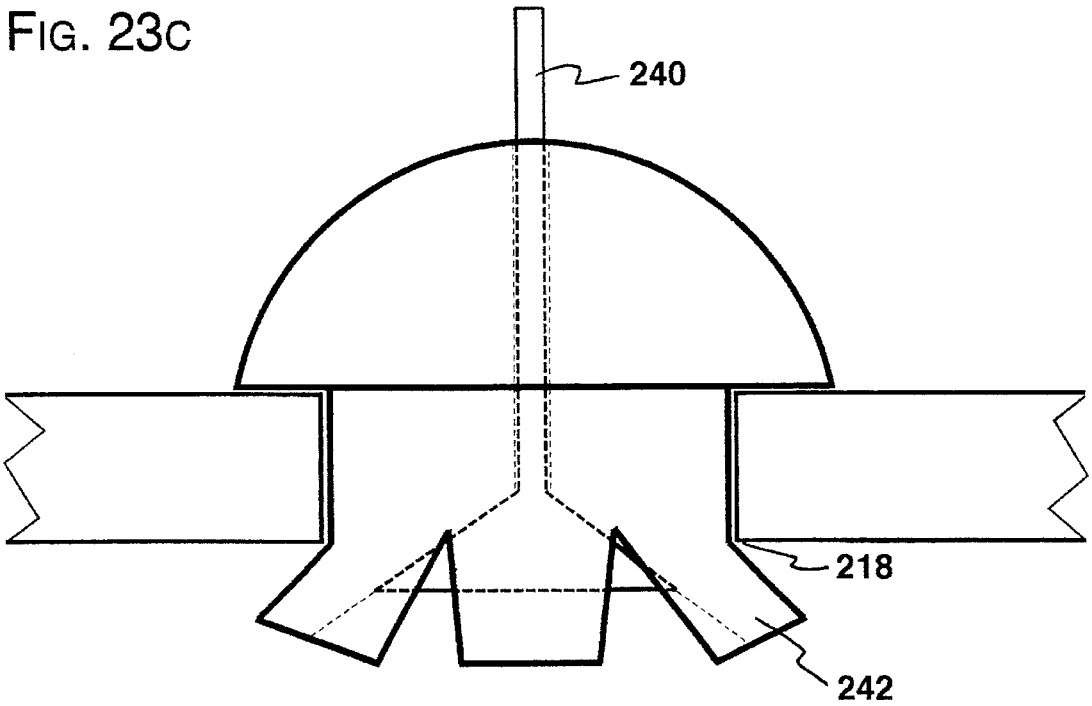

Pull-stem 240, in side view in FIG. 23C, is shown after upward pull-force has been applied showing an expanded rivet stem 242 against handguide opening-edge 218.

Figure 23D:
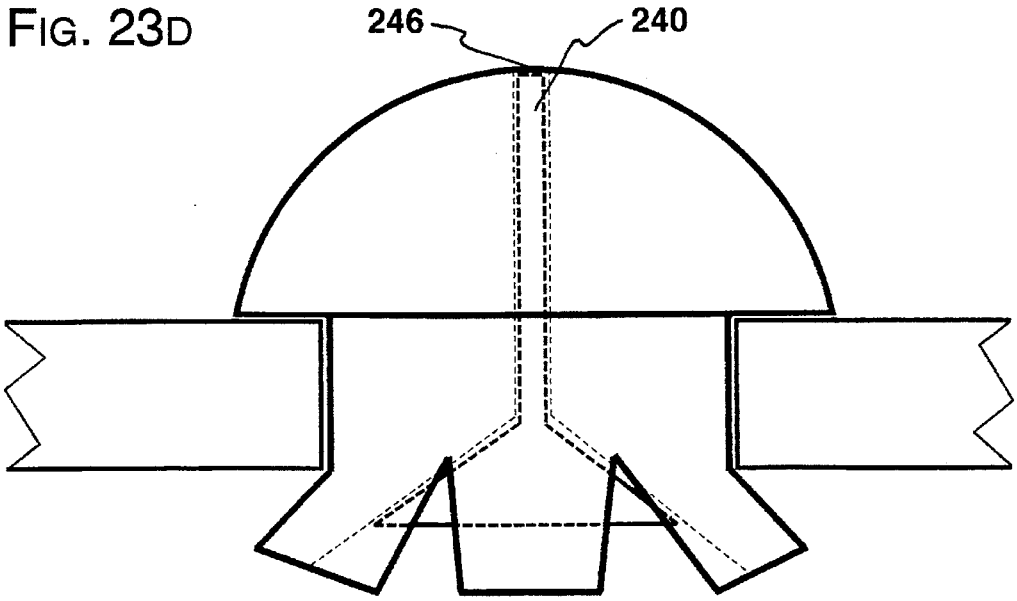

The expanded rivet, in side view in FIG. 23D, is shown after pull-stem 240 has been cut to a level that is flush with dome surface 246.

OPERATION

Dome-Shaped Element as an Expansion Rivet

Another variation of the indicator, in this case a rivet-style with dome shape, is illustrated in sequence of operation for installation as shown in FIGS. 23A through 23D.

Shown prior to insertion, in FIG. 23A, is a dome-shaped, expansion element 239, with central pull-stem 240, positioned above predrilled opening 206 on handguide 208. Pull-stem 240 is not activated.

Shown in FIG. 23B is element 239 after its insertion into opening 206. Pull-stem 240 is still not activated.

Pull-stem 240, in FIG. 23C, is shown after activation. An upward force has been applied to the pull-stem to cause the bottom part of the rivet stem to flare out. Expanded rivet stem 242 exceeds the diameter dimension of the opening so as to contact the under surface of the handguide at handguide opening edge 218. This contact serves to lock the element into position.

The fastened element, in FIG. 23D, is shown after pull-stem 240 is cut flush to dome surface 246 of the element. The cutting results in a clean, cosmetic appearance because it eliminates the protruding portion of pull-stem 240, which becomes unnecessary at this point.

DESCRIPTION

Drill-Bit Template

FIGS. 24A to 24E

Figure 24A:
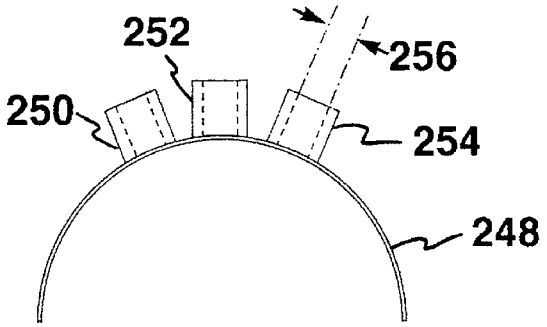
FIGS. 24A through 24E show a mounting template that can be used to predrill handguide holes for indicator elements that require this style of connection.

A thin-walled, flexible drill-bit template 248, in side view in FIG. 24A, shows integral left, central, and right drill-bit guides 250, 252, and 254. Right guide 254 shows a drill-bit guide shaft 256.

Figure 24B:
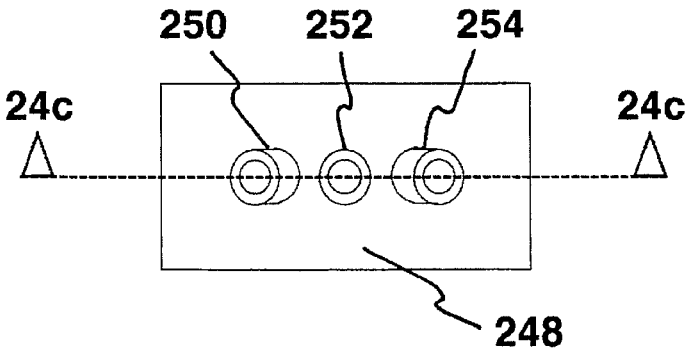

Template 248, with guides 250, 252, and 254, is shown in plan view in FIG. 24B. A cross-section of the drill-bit template, taken at line 24C—24C, is detailed in FIG. 24C.

Figure 24C:
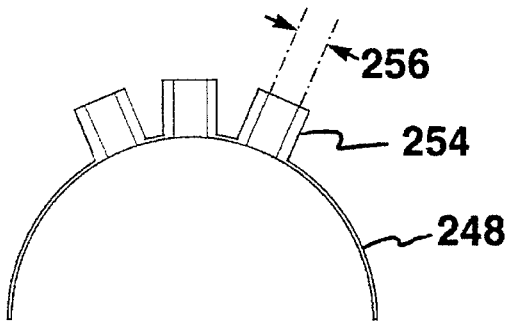

A cross-sectional detail in FIG. 24C shows template 248 with guides including guide 254 with shaft 256.

Figure 24D:
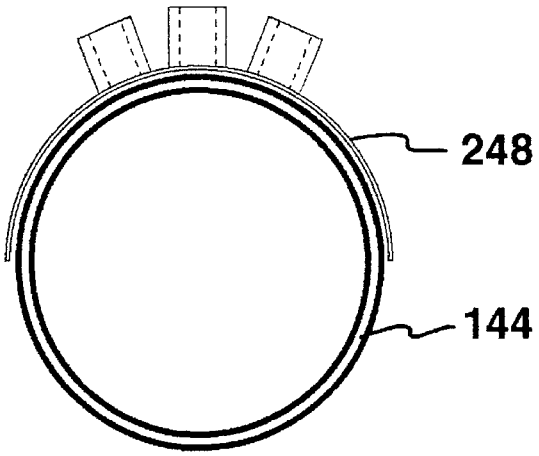

Template 248, which is shown in side view in FIG. 24D, is positioned onto the exterior surface of handguide 144, which is shown in sectional detail.

Figure 24E:
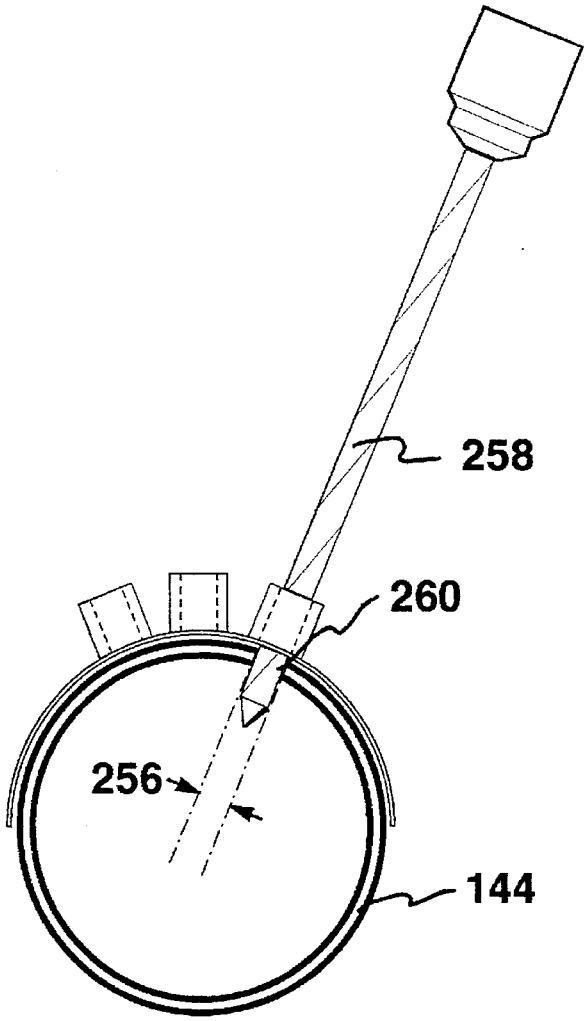

A drill bit 258 in shaft 256, illustrated in side view in FIG. 24E, is shown after having pierced designated hole 260 in handguide 144, which is illustrated in sectional detail.

OPERATION

Drill-Bit Template

A drill-bit template, showing its use on a handguide, is illustrated in FIGS. 24A through 24E. It is used to assist in drilling element holes in order to achieve proper, consistent element alignment during installation. These element holes are drilled for elements whose designs require holes as part of their fastening system.

Flexible drill-template 248 is shown in side view in FIG. 24A. Each drill-bit guide, 250, 252, and 254, has a guide shaft. Shaft 256, of guide 254, has a diameter that is similar to that of a proposed drill-bit, which is used to make a designated hole. The shaft diameter is also similar to the diameter of a chosen element's rivet stem, which will be inserted into the designated hole upon installation. Because each guide is permanently attached and anchored to template 248, orientation and alignment of guide shafts (as well as spacing between the shafts) permit the installer to drill the proper pattern of holes on a consistent basis. This insures that the drilled holes are accurate and at the optimum angle and that the pattern of inserted elements is uniform among all installations.

Flexible drill-template 248 is shown in plan view in FIG. 24B. Guides 250, 252, and 254 are offset, in other words, not parallel, to one another due to the curvature of the template. This offset allows a drill-bit, that is introduced through each guide shaft, to be capable of drilling an opening or hole in a direction that is exactly perpendicular to the surface of the handguide. Therefore, the shaft direction of each shaft faces exactly 90° to the drill surface or handguide surface. Since template 248 conforms to the curved handguide surface, the adjoining guides with their respective shafts, always properly orient the drill-bit so as to keep the drill-bit from boring into the curved handguide surface at an incorrect angle.

Template 248, in FIG. 24C, shows a cut-away perspective of FIG. 24A. The guide shafts and template are shown as a single, molded part.

Template 248, in FIG. 24D, is shown as it conforms to the profile of handguide 144. The template, which is typically composed of a soft or non-brittle plastic, is flexible enough so that it is able to conform to the profile shape and size of most pipe-style handguides. If the diameter of the handguide or the radius of its surface is larger or smaller than that which is shown, the template can assume the differing dimension due to the built-in flexion of the template.

Drill-bit 258, in FIG. 24E with the template mounted on handguide 144, is shown guided by shaft 256 and having just penetrated the handguide at designated hole 260. After two more holes are made using the other two guides, the template is removed and the appropriate indicator elements are inserted.

DESCRIPTION

Figure 25A:
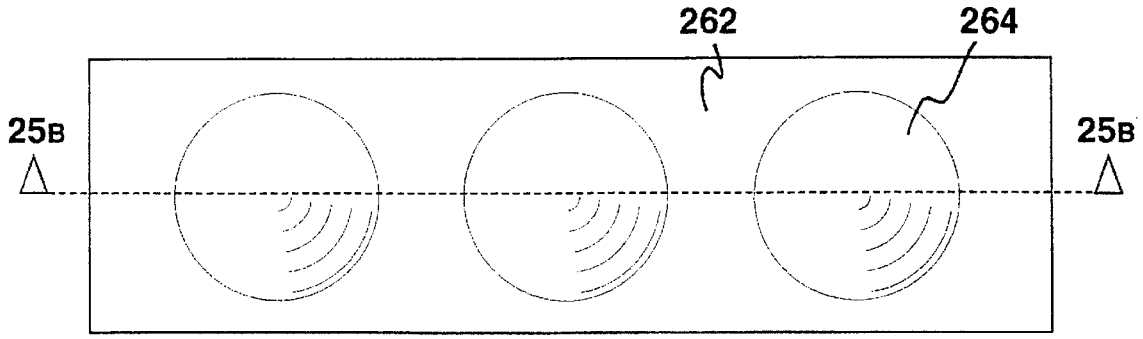
FIGS. 25A through 25C show an alternative indicator configuration in which the indicator domes are integrated into a flat, flexible membrane.
Figure 25B:
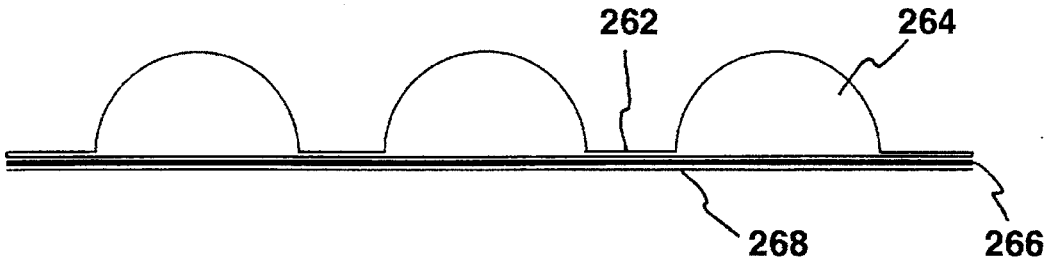
Figure 25C:
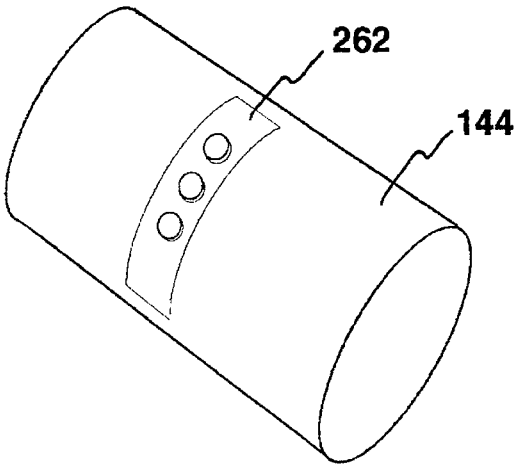

One-Piece Membrane with Indicator Domes (Elements)
FIGS. 25A to 25C

An integrated indicator in FIG. 25A shows in an exploded, plan view a solid, flexible, flat membrane 262 with integrated domes (elements), including a dome 264. A cross-section of the integrated indicator taken at line 25B—25B is detailed in FIG. 25B.

An integrated indicator in FIG. 25B is a cross-sectional detail showing membrane 262, dome 264, a contact-adhesive layer 266, and a protective peel-off liner 268.

Membrane 262, shown in an oblique view in FIG. 25C, is attached to the surface of a small section of handguide 144.

OPERATION

One-Piece Membrane with Indicator Domes (Elements)

An indicator, shown in FIGS. 25A through 25C, illustrates a flexible, one-piece, thin membrane having properly-spaced, integrated domes (elements). The entire piece is secured to a handguide using an adhesive.

A solid, flexible, flat membrane 262, shown in FIG. 25A, is typically composed of a soft or non-brittle plastic. This allows the membrane to conform to curved surfaces easily. The membrane has a series, in this case three, integrated domes, such as dome 264. The domes can be composed of any material that is identical, similar, or different to that of the membrane itself.

Dome 264 can be more easily seen from the sectional view in FIG. 25B. It rises substantially above the surface of membrane 262. Contact-adhesive layer 266 is exposed when protective peel-off liner 268 is removed. This allows the adhesive on the bottom surface of the membrane to be applied to any designated surface on a handguide. This system can eliminate the need for an installation mounting template or for a drill-bit template since the elements (domes) are integrated with the membrane as one unit.

FIG. 25C shows membrane 262, with integrated domes, as it is typically mounted. Membrane 262 is illustrated as it conforms to the curved surface on segment of handguide 144.

DESCRIPTION

Figure 26A:
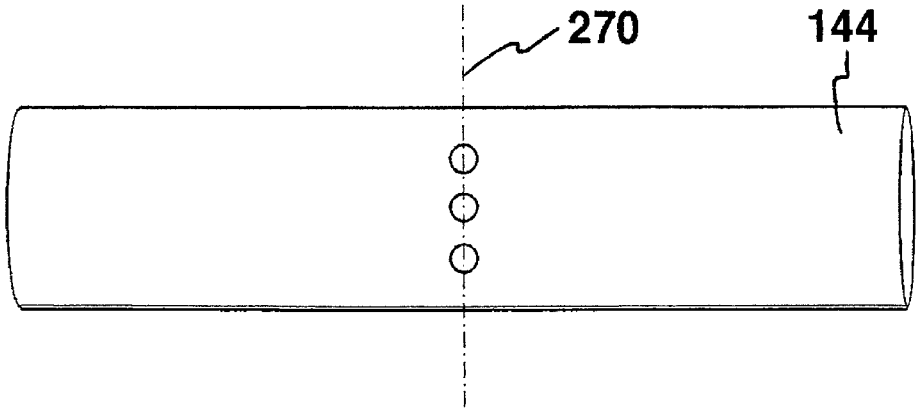
FIGS. 26A through 26C show, in plan view on a small section of handguide, alternative examples of dome-shaped indicator elements with regard to element orientation and to the number of elements.
Figure 26B:
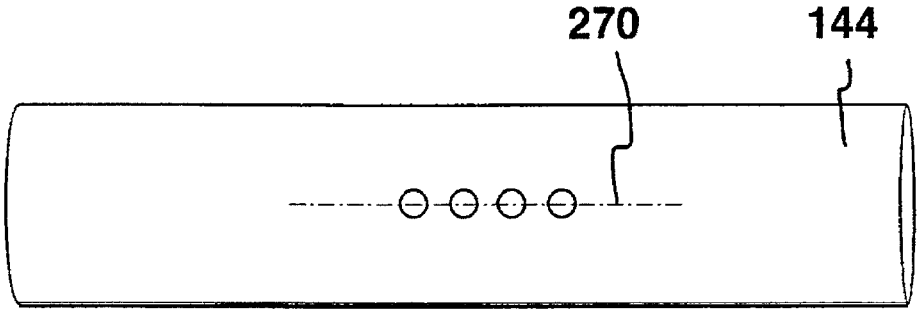
Figure 26C:
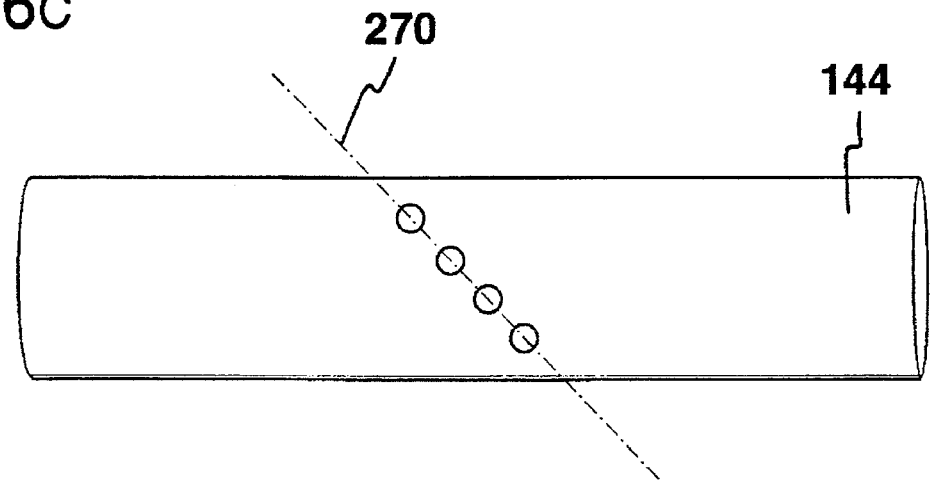

Dome-Shaped Element Configurations
FIGS. 26A to 26C

Shown on handguide 144 in plan view in FIG. 26A are three half-sphere, dome-shaped elements, in a linear alignment 270 that is perpendicular to the direction of the handguide.

Shown on handguide 144 in plan view in FIG. 26B are four half-sphere, dome-shaped elements, in alignment 270 that runs parallel to the direction of the handguide.

Shown on handguide 144 in plan view in FIG. 26C are four half-sphere, dome-shaped elements, in alignment 270 that is diagonally-offset to the direction of the handguide.

OPERATION

Dome-Shaped Element Configurations

Although foregoing variations of the device have been shown as three-element, dome-shaped element indicators, it can include, but not be limited to, other possible arrangements of elements in regards to orientation and number. Three examples of alternate configurations of dome-shaped elements are shown in FIGS. 26A through 26C. Each indicator configuration illustrates a specific number of elements in an orientation that is distinctive. Therefore, elements, in any number and of any shape or design, can be arranged in a pattern that is deemed to be meaningful and of prominence to the staircase user.

For instance, three elements, in FIG. 26A, are shown in linear alignment 270 in a direction that is perpendicular to the direction of the handguide.

Four elements, in FIG. 26B, are shown in linear alignment 270 in a direction that is parallel to the direction of the handguide.

Four elements, in FIG. 26C, are shown in linear alignment 270 in a direction that is diagonal to the direction of the handguide.

DESCRIPTION

Figure 27A:
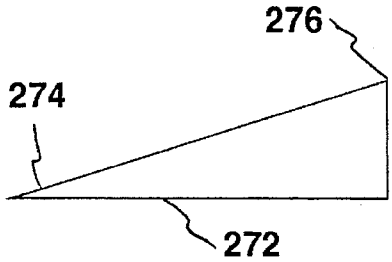
FIGS. 27A' through 27F show an example of last-step indicators as they would appear and mount on escalators.
Figure 27A:
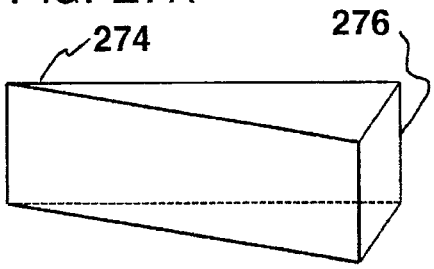
Figure 27A:
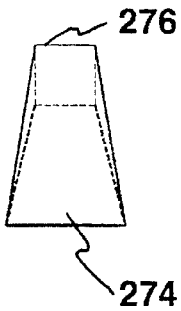

Indicator and Timing Blocks for Escalators
FIGS. 27A', 27A", 27A"', 27B, 27C, 27D, 27E, and 27F A wedge-shaped indicator and timing block is shown in side view in FIG. 27A'. A wedge-shaped indicator and timing block is shown in oblique view in FIG. 27A". A wedge-shaped indicator and timing block is shown in frontal view in FIG. 27A"'. A block-mount surface 272 is typically mounted against an escalator handguide support or handguide frame. When the block is mounted, a leading surface 274 is oriented in a way that faces toward approaching escalator pedestrians. When the block is mounted, a tactile edge 276 is oriented in a way that faces toward the near-by end of an escalator.

Figure 27B:
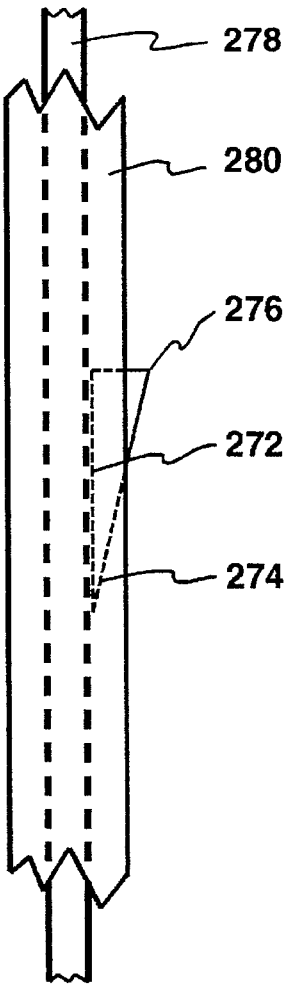
FIG. 27B is a plan view of a section of escalator handguide showing a single indicator and timing block mounted to a handguide frame.

An escalator handguide, shown in plan view in FIG. 27B, is illustrated with the wedge-shaped indicator and timing block mounted on a stationary handguide frame 278 which is directly under a moving handguide 280. This illustrates positioning of surface 272, surface 274, and edge 276.

Figure 27C:
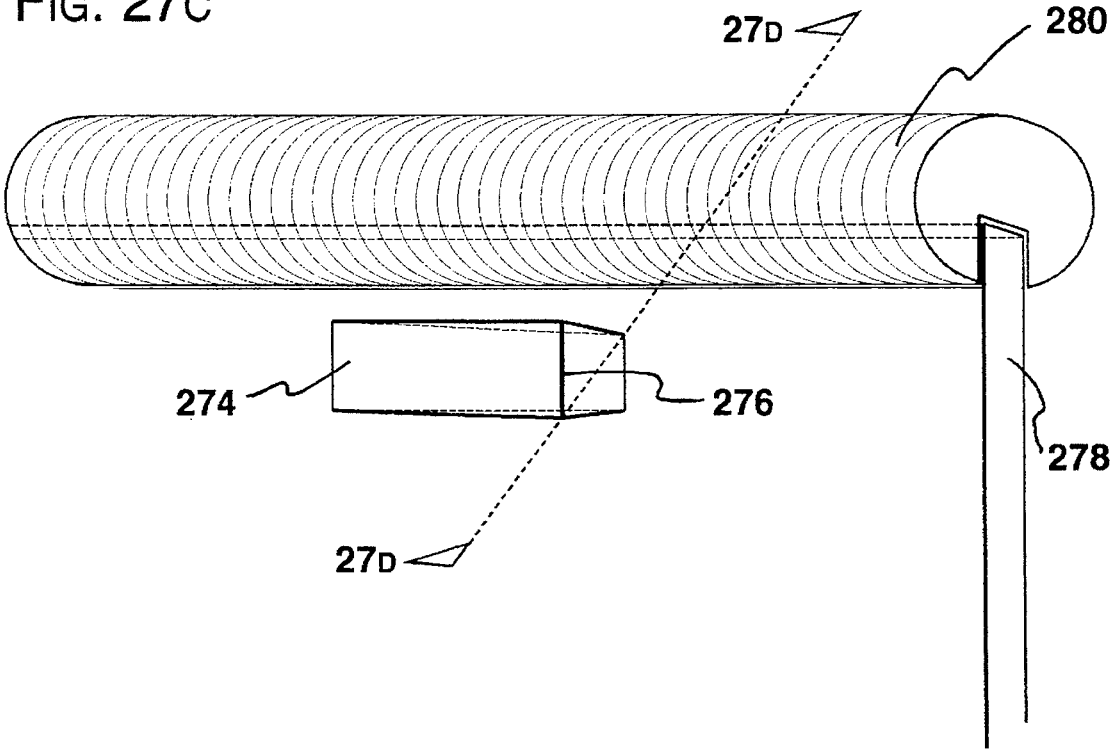
FIG. 27C is an oblique view of a section of escalator handguide showing a single indicator and timing block mounted to the handguide frame.

An indicator and timing block mounted on an escalator handguide frame is shown in oblique, side view in FIG. 27C. Frame 278, with handguide 280, is shown with the mounted indicator and timing block illustrating surface 274 and edge 276. A cross-section of the escalator taken at line 27D—27D is detailed in FIG. 27D.

Figure 27D:
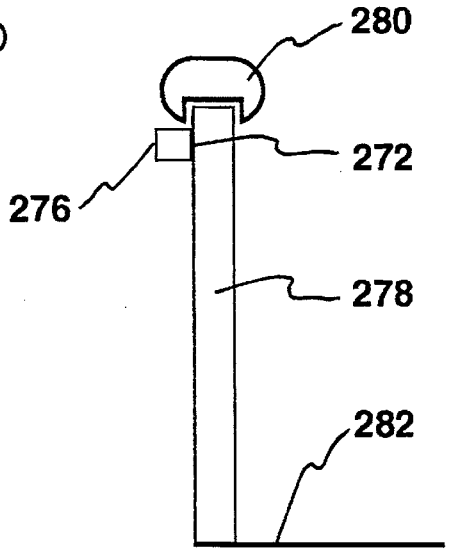
FIG. 27D is a sectional view of an escalator handguide and frame taken in the direction indicated by section line 27D—27D in FIG. 27C.

A sectional detail of an escalator in FIG. 27D shows frame 278, with handguide 280, and a rear view perspective of the indicator illustrating edge 276 and surface 272. The indicator and timing block are shown mounted on the handguide frame surface that is exterior to a pedestrian step 282.

Figure 27E:
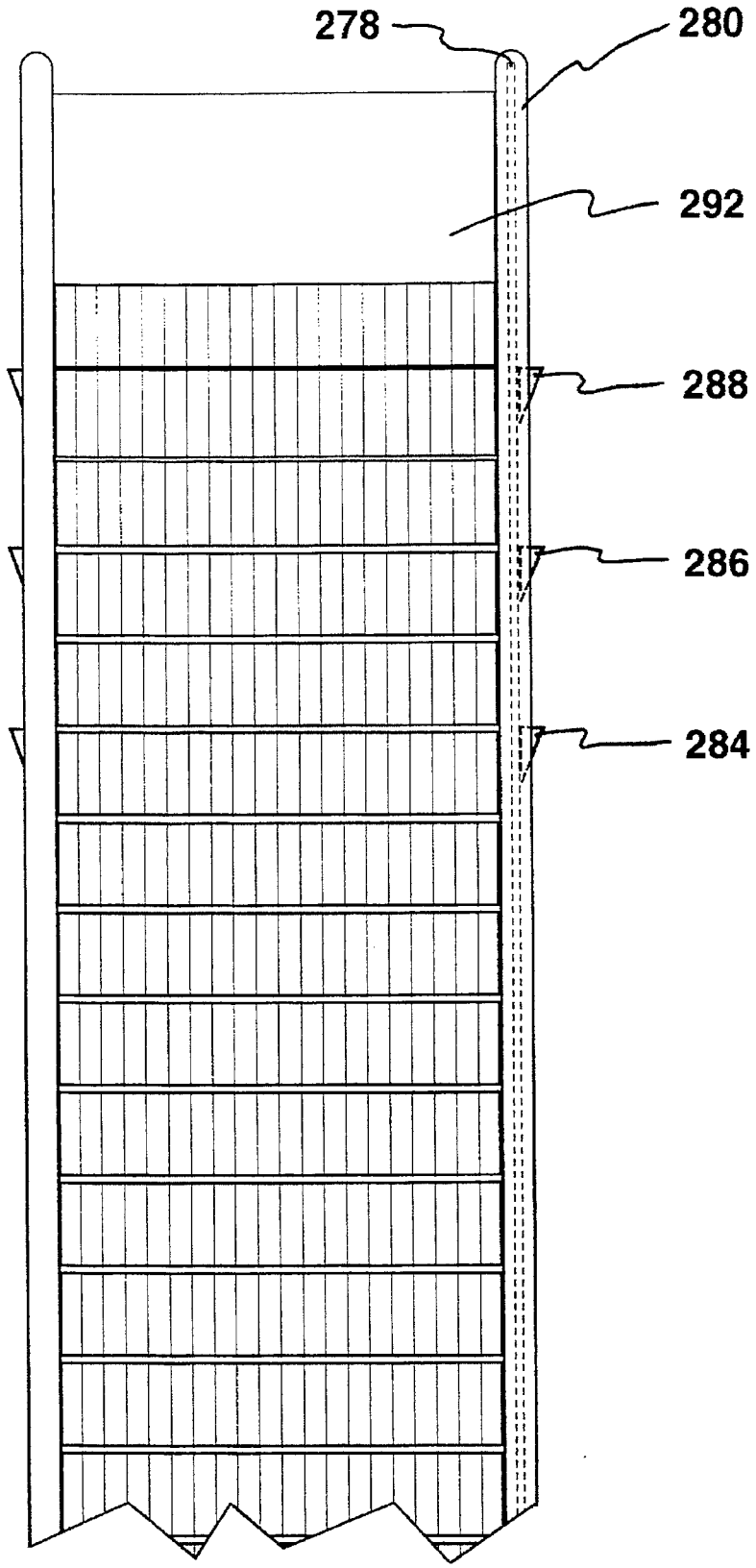
FIG. 27E is a plan view of the end of an escalator showing the relative positioning of indicator and timing blocks.

The end of an escalator is shown in plan view in FIG. 27E. Protruding out from underneath both handguides, including handguide 280, is a set of three indicator and timing blocks mounted on the exterior surface of each handguide frame. Illustrated on the right handguide frame is a block called a primary-encounter-block 284; a block called a first cadence-block 286; and a block called a second cadence-block 288. A non-moving step, which serves as part of the level floor surface, is shown as termination point 292.

Figure 27F:
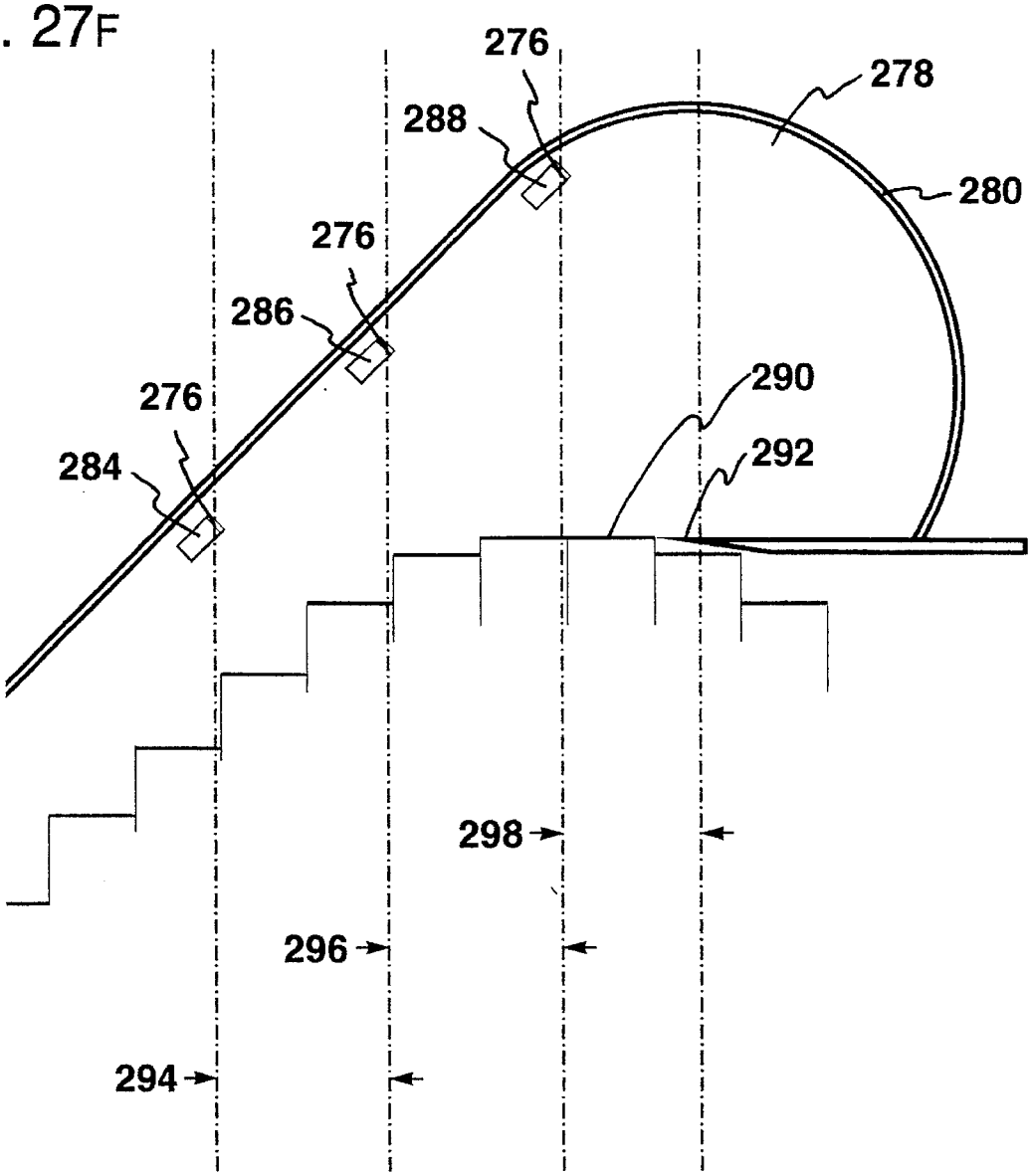
FIG. 27F is a side view of the end of an escalator showing the relative positioning of indicator and timing blocks.

The end of an escalator is shown in side view in FIG. 27F. It illustrates one set of three indicator and timing blocks mounted on frame 278, which is transparent, directly underneath handguide 280. Rising escalator steps, including step 290, terminate from view at termination point 292. Horizontal distance spacing between blocks 284 and 286 is called an "interval number one" 294. Horizontal distance spacing between blocks 286 and 288 is called an "interval number two" 296. Horizontal distance spacing between block 288 and point 292 is called an "interval for stepping" 298. Each indicator and timing block evidences edge 276.

OPERATION

Indicator and Timing Blocks for Escalators

How Problems Posed with Escalators are Solved

A variation of the last-step indicator for escalators is illustrated in FIGS. 27A' through 27F. Because escalator handguides move concurrently with steps and pedestrians, previously illustrated and described last-step indicators for stationary handguides, when placed on moving handguides, are of no value. A hand holds an escalator handguide at only one location and does not slide along the surface of the handguide. Consequently, in order for a hand, which grasps a moving handguide, to encounter an indicator, the indicator-attachment for escalators must be on a non-moving part. This non-moving part is the guide-frame upon which the handguide slides. A last-step indicator for escalators is therefore attached just below the handguide on the handguide frame so that a pedestrian's fingers brush against the indicator when encountered. Because hand-placement on an escalator handguide can vary, it is necessary to use an indicator that is substantially more prominent than standard staircase versions discussed and explained previously. This is why a wedge-shaped indicator block is used. However, even with a single indicator block present, a non-sighted or partially-sighted escalator-user can have difficulty knowing exactly when to step off the escalator. Timing, therefore, presents an additional problem. For instance, escalator speed can vary. Most importantly, no time-frame reference exists. Even after detecting one indicator block, an escalator-user can still step too soon or too late and, as a consequence, fall. Therefore, it is necessary to establish a system that generates a frame-of-reference for timing. Using indicator blocks in series provides the needed cadence to precisely alert the user as to when to step. Therefore, last-step indicators for escalators are called timing blocks as well as indicator blocks.

Underlying Aspects of Escalator Indicators

The wedge-shaped indicator and timing block is shown in FIGS. 27A', 27A", and 27A"'. Leading surface 274 is the location where a pedestrian's fingers initially contact the block. As opposed to a blunt, flat, perpendicular surface that can harshly strike oncoming hands, the incline surface of the wedge-shape prevents the block from snagging or injuring fingers. After fingers traverse the sloped surface of the wedge, they fall or snap back over tactile edge 276 towards the guide frame. Fingers snap back because they have a natural tendency to curl around the handguide. Edge 276, therefore, serves as a point-of-reference, since traversing fingers find it to be distinct and noticeable. Block-mount surface 272 is the surface that is attached to the guide frame. It is typically attached with an adhesive but can be bolted, screwed, riveted or mechanically fastened or integrated in any number of ways.

Positioning of Escalator Indicators

A segment of escalator handguide and guide frame, with a mounted indicator and timing block, is shown in FIG. 27B. Stationary handguide frame 278, which is directly under moving handguide 280, is the non-moving part upon which block-mount surface 272 is attached. As an escalator user approaches the end of an escalator, his or her fingers, which are curled around the moving handguide, safely contact leading edge 274, traverse the slope of the wedge, encounter edge 276, and finally snap back toward the surface of handguide frame 278. This moment of going over the edge and "snapping back" serves as a point-of-reference.

FIG. 27C shows an indicator and timing block mounted on guide frame 278 below a section of handguide 280. As one's hand travels from left to right, fingers encounter surface 274. After sliding over and past edge 276, fingers, having a natural tendency to curl around the handguide, snap back toward the surface of the handguide frame.

Handguide 280, frame 278, and pedestrian step 282 are seen in FIG. 27D. Surface 272 of the indicator block is shown attached to the outside of frame 278. Indicator blocks are typically mounted on the exterior side of the frame, opposite the side facing the escalator steps, such as step 282. This preferred mounting position is due to the fact that fingers, rather than a thumb, are more likely to curl around underneath the handguide to contact the indicator. Edge 276 is seen from the rear perspective.

Installation and Functional Aspects of Multiple Escalator Indicators

The end of an escalator, shown in FIG. 27E, illustrates in plan view the relative positioning of multiple indicator and timing blocks. The direction of pedestrian travel is toward the escalator end shown. Stationary handguide frame 278 is seen directly under moving handguide 280. As the pedestrian approaches the end of the escalator, he or she encounters and manually senses the first block called primary-encounter-block 284. At this point the pedestrian is made aware that an upcoming last step is near-by. Within a brief moment, his or her hand senses first cadence-block 286. Between blocks 284 and 286, a time-interval frame-of-reference is established. When his or her hand encounters second cadence-block 288, a second and identical time-interval, between blocks 286 and 288, is realized. Having sensed and "learned" equal time-intervals "one" and "two", the pedestrian is able to discern and anticipate that the time-interval between block 288 and termination point 292 is precisely one more time-interval, identical to the first and second intervals. The cadence, therefore, that is established by intervals "one" and "two", allow the pedestrian to know exactly that he or she must step off the escalator on "three", the end of the third and final time-interval. Determination for stepping off the escalator, therefore, relies not only on detecting a series of blocks but on realizing and understanding the time-intervals between the blocks.

The end of an escalator, shown in FIG. 27F, illustrates in side view the relative positioning of multiple indicator and timing blocks. As in FIG. 27E, the direction of pedestrian travel in FIG. 27F is toward the escalator end shown. Stationary handguide frame 278 is seen directly under moving handguide 280. As the pedestrian approaches the end of the escalator, he or she encounters and manually senses block 284. The identifying point-of-reference is established when his or her fingers snap over block 284 at edge 276. At this point, the pedestrian is made aware of an upcoming last step. Soon, his or her fingers sense block 286 and identify the second point-of-reference at edge 276 of block 286. Between blocks 284 and 286, a time-interval frame-of-reference is established. This is the time that transpires between the horizontal distance traveled between both blocks. It is called "interval number one" 294. When the moving hand encounters block 288, identifying it at its edge 276, a second and identical time-interval, between blocks 286 and 288, is realized. It is called "interval number two" 296. Having sensed equal time-intervals "one" and "two", the pedestrian is able to discern that the "interval for stepping" 298 between block 288 and termination point 292 is precisely one more identical time-interval. As the interval for stepping is completed, the pedestrian steps off escalator step 290 onto the floor or landing at termination point 292. Therefore, the pedestrian, without the need of any vision, exits from the escalator safely.

DESCRIPTION

Figure 28A:
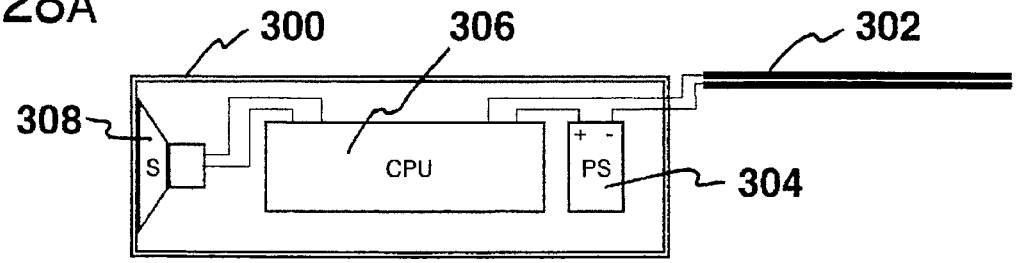
Figure 28B:
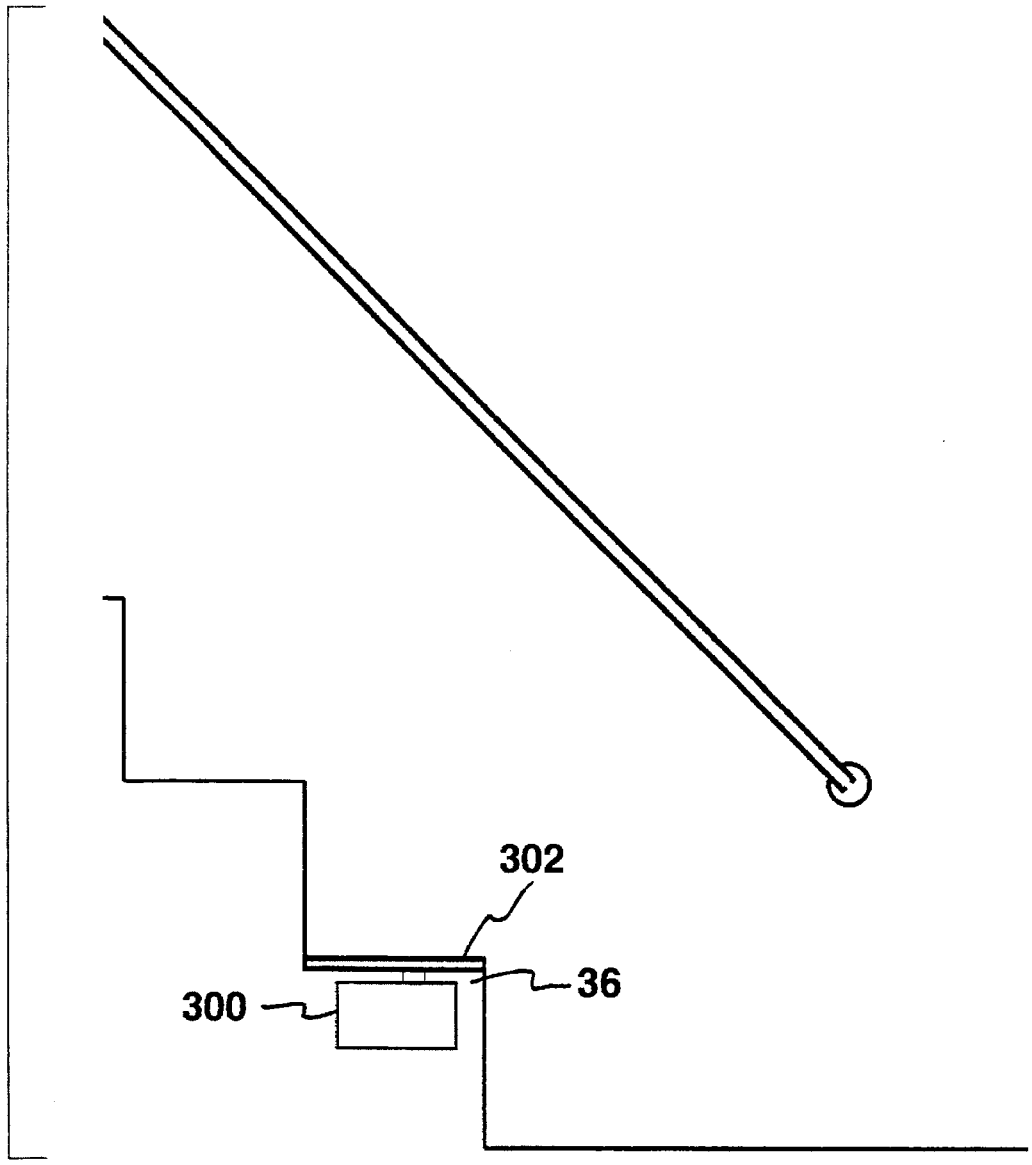

Audio-Style (Non-Tactile) Indicator
FIGS. 28A and 28B

Although last-step indicators have been described as hand-tactile devices, indicators can function in such a way as to arouse another sense, namely, the auditory sense. FIGS. 28A and 28B show one possible way an audio/last-step indicator may exist and function.

An audio-style last-step indicator 300 is shown in FIG. 28A, a simplified diagram. It is composed of a power source 304 that is labeled "PS", a signal generator or processor 306 that is labeled "CPU", and a speaker 308 that is labeled "S". An external part, called an external pressure switch 302, is shown wire-connected to indicator 300.

Power source 304 is shown as a direct current battery, a remote or independent source of power. However, power source 304 can also be a system, with or without a direct current transformer, that uses alternating current power, a system that connects directly to a building's conventional electrical lines. Processor 306 functions when switch 302 is activated causing a discernable change of value in the movement of electrons in the connections between various components. When activated, processor 306 uses electrical power to produce a response that is transferred to speaker 308 which in turn projects it as a distinctive, audible signal.

A staircase, shown in side view in FIG. 28B, illustrates indicator 300 mounted directly below and beside switch 302 which has been positioned on next-to-bottom step 36.

OPERATION

Audio-Style (Non-Tactile) Indicator

Audio-style last-step indicator 300, shown in FIG. 28A, is made up of several components. Such components are shown in a generalized way for simplicity. Power source 304 provides the necessary electrical current. Processor 306 receives electrical input, processes it, and generates a response to a speaker. Speaker 308 converts this response to a recognizable message or tone. Switch 302 is step-activated by a pedestrian just before the stair user reaches a last step.

When installed, as shown in FIG. 28B, switch 302 is mounted directly on a next-to-bottom (or next-to-top) step. When the pressure switch is stepped-on, the electrical circuit is activated. This allows the power source of indicator 300 to activate processor 306. Processor 306, in turn, sends a response to the speaker which produces a recognizable warning tone or message. When the tone or message occurs, the pedestrian hears the notice of being on the next-to-bottom (or next-to-top) step with one last step ahead. The stair user, now cognizant, safely encounters the last step.

SUMMARY, RAMIFICATIONS, AND SCOPE OF INVENTION

Accordingly, the reader will see that last-step indicators of this invention provide a measure of great personal safety. Staircase pedestrians, who, for any reason, are visually unable to discern a staircase's last step, now have an important navigational aid at their disposal. When traversing a set of stairs, they can manually detect a last-step indicator, which serves as an important alerting cue. Indicators provide precise notification to stair users approaching the final step. When a staircase pedestrian's hand detects and recognizes the tactile indicator, it conveys that travel direction is about to shift abruptly. For the blind, the visually impaired, or the visually compromised, indicators become a manual "guiding light".

The last-step indicator provides a unique, prominent tactile surface. Its profile is unobtrusive. The size, shape, spacing, surface-style, rounded ends, configuration, and orientation of the elements insures ease of recognition as well as longevity and comfort in use.

Coloration and lighting of elements heightens general public awareness. It also helps attract visual attention should the pedestrian in need have some visual acuity at the time.

Textured exterior surfaces on the elements, when incorporated, enable a pedestrian's sensory ability to be enhanced.

Standardized positioning of indicators prior to last steps insures that staircase users have sufficient time to detect, recognize, and respond.

A special version of the indicator, the four-element configuration, offers an additional advantage. As well as offering last-step identification, it provides more safety information. It notifies that the beginning of another staircase is nearby. This helps prevent stair-entry accidents.

The peel-and-stick mounting adhesive on the indicators flat, mount surface provides convenience for the installer. The installation mounting template provides a simple method for consistent and precise installation of indicators. When the template is used for installation, elements are maintained in proper orientation and spacing. It speeds the process for installing multiple elements.

While our above description contains many specificities, these should not be construed as limitations on the scope of the invention, but rather as an exemplification of one preferred embodiment thereof. Many other variations are possible. For example:

The indicators can have a subtly, moderately, or radically different appearance, shape, size, style, and configuration to the ones described and illustrated. Rather than being protuberances, they can be depressions, grooves, holes, channels, etc. in the handguide.

The indicators may be manufactured or integrated into new handguides by railing manufacturers. In such a case, indicators can be carved, welded, molded, etc. as well as attached with adhesive. In such cases, indicators may be of the same material and color as that of the handguide itself.

The indicators may be screwed, riveted, nailed, bolted, etc. to the handguide. In such cases, the heads of the screws, rivets, nails, bolts, etc. themselves can serve as the indicators. An installation handtool that serves as a screwing, riveting, pounding, bolting, etc. device can be employed.

The indicators may be placed on the stairway wall instead of on the handguide.

Because escalators present a different circumstance with last-step safety, an escalator version of the indicator incorporates several wedge-shaped indicator and timing blocks. Located just under the moving handguide, these blocks are attached to the stationary guide frame. Escalator-user fingers contact the blocks and feel these equally-spaced indicators in succession. Encountering the blocks establishes a cadence in the pedestrian's mind, i.e., "1", "2", "3-Step". Therefore, these indicators, as well as being a tactile cue, serve as a timing mechanism. They tell the escalator user exactly when to step onto the approaching floor or landing.

The indicators may trigger one of the other non-visual/non-tactile human senses. Specifically, an audible message or sound can be designed to occur when the staircase user nears the final step. In this case, an indicator can be triggered by a pedestrian contacting a pressure switch mounted directly on a next-to-bottom (or next-to-top) step or onto the handguide itself directly above such step. Therefore, such an indicator can be activated by foot contact or by hand pressure.

Other variations of the indicator may include ones that are enabled by way of radar, infrared or microwave radiation, that utilize properties of or that are sensitive to heat or motion, that are photo-cell sensitive, that are logic related, that are foot-tactile/hand-tactile or that are a combination of these.

Accordingly, the scope of the invention should be determined, not by the embodiments illustrated, but by the appended claims and their legal equivalents.

We claim:

1. In a staircase structure having at least a staircase section including a handguide therefor, a staircase-end warning device comprising: a relatively small size, unitary, tactile element of a predetermined configuration; said element operably attached a predetermined distance before an end of said staircase section; said tactile element having a surface for providing a humanly discernible interrupting sensation to a hand of a pedestrian traversing said staircase section; and wherein said tactile element is positioned so that said pedestrian will encounter said tactile element when said pedestrian is near said end of said staircase section, thereby warning said pedestrian of the end of said staircase section.

2. The warning device of claim 1 wherein said surface on said tactile element is a protuberance of a predetermined size so that said interrupting sensation can be detected by touch of said pedestrian.

3. The warning device of claim 1 wherein said staircase section is stationary, and said handguide is proximate to said staircase section, said device being mounted on said pedestrian handguide.

4. The warning device of claim 3 wherein said predetermined configuration of said tactile element has a discernible shape that has an anti-snag feature for preventing said device from snagging on clothing, objects and skin of said pedestrian when said pedestrian contacts said device.

5. The warning device of claim 3 wherein said predetermined confirmation of said tactile element has a discernible shape and color so as to catch the eye for attracting attention of said pedestrian when said pedestrian is proximate to said device.

6. The warning device of claim 3 wherein said surface of said tactile element comprises a plurality of protuberances.

7. The warning device of claim 9 wherein said plurality of protuberances are in a patterned arrangement.

8. The warning device of claim 3 wherein said attaching means of said tactile element includes a mounting surface and has an accommodation means for element installation on any of a plurality of profile shapes.

9. The warning device of claim 2 wherein said protuberance of said tactile element has a undulating or recurrent pattern.

10. A method of warning a pedestrian traversing a staircase structure having at least a staircase section including a handguide therefor that said pedestrian is approaching a last step of said staircase section, comprising the steps of: providing a relatively small size, discrete indicating means for indicating that said pedestrian is approaching said last step of said staircase section; attaching said indicating means proximate to said staircase section before the last step thereof so that said pedestrian detects said indicating means by a hand of said pedestrian while traversing said staircase section.

11. The method of claim 10 wherein said indicating means is a haptics indicator.

12. The method of claim 11 further including the step of mounting said haptics indicator on said handguide which is adjacent said staircase section.

13. The method of claim 12 wherein said haptics indicator is a series of undulating protrusions formed on a unitary element.

14. A method of installing an indicator device proximate to a staircase structure having at least a staircase section and handguide therefor so as to enable a staircase pedestrian to identify an end of said staircase section, comprising the steps of: providing a relatively small, discrete indicating means for indicating the end of said staircase; positioning and attaching said indicating means on said handguide before the last step of said staircase section so as to come in contact with a hand of said pedestrian when traversing said staircase section.

15. The warning device of claim 1 wherein said staircase section and handrail therefor are moving, and wherein said device is mounted in a fixed position just below and outboard said moving handrail near the end of said moving staircase section.

16. The warning device of claim 15 wherein said device is wedge-shaped with the incline rising in the direction of the moving handrail.

17. The warning method of claim 10 wherein said staircase section and included handguide is an escalator having a moving staircase and moving handrail in combination.

* * * * *